US006844662B2

(12) United States Patent
Morita et al.

(10) Patent No.: US 6,844,662 B2
(45) Date of Patent: Jan. 18, 2005

(54) SPARK PLUG AND IGNITION APPARATUS

(75) Inventors: Hitoshi Morita, Aichi-ken (JP); Shinichi Okabe, Okazaki (JP); Takehiko Kato, Gamagoori (JP); Hiroshi Yorita, Kariya (JP); Keiji Kanao, Aichi-ken (JP); Tetsuya Miwa, Nagoya (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 0 days.

(21) Appl. No.: 10/661,568

(22) Filed: Sep. 15, 2003

(65) Prior Publication Data

US 2004/0061421 A1 Apr. 1, 2004

Related U.S. Application Data

(62) Division of application No. 09/960,514, filed on Sep. 24, 2001, now Pat. No. 6,653,767.

(30) Foreign Application Priority Data

Oct. 3, 2000 (JP) ..... 2000-303896
Aug. 28, 2001 (JP) ..... 2001-257971

(51) Int. Cl.[7] ..... H01T 13/20
(52) U.S. Cl. ..... 313/141; 313/143; 315/59

(58) Field of Search ..... 313/118, 141, 313/142, 143, 144; 445/1, 7; 315/49, 50, 55, 58, 59

(56) References Cited

U.S. PATENT DOCUMENTS

| | | | | |
|---|---|---|---|---|
| 5,461,275 | A | 10/1995 | Oshima | 313/141 |
| 5,898,257 | A | 4/1999 | Sequerra et al. | 313/141 |
| 6,265,814 | B1 * | 7/2001 | Yoshinaga et al. | 313/141 |
| 6,304,022 | B1 | 10/2001 | Matsutani | 313/141 |
| 6,346,766 | B1 * | 2/2002 | Kanao et al. | 313/141 |
| 6,412,465 | B1 * | 7/2002 | Lykowski et al. | 313/141 |

FOREIGN PATENT DOCUMENTS

| | | |
|---|---|---|
| JP | 52-36237 | 9/1975 |
| JP | 10-41047 | 2/1998 |
| JP | 11-204233 | 7/1999 |

* cited by examiner

*Primary Examiner*—Wilson Lee
(74) *Attorney, Agent, or Firm*—Nixon & Vanderhye, PC

(57) ABSTRACT

At least one of a center electrode tip and a ground electrode tip is made of an iridium alloy. A discharge gap, formed between the center electrode tip and the ground electrode tip, is less than 1.1 mm. And, cross sections of the center electrode tip and the ground electrode tip are equal to or smaller than 0.95 $mm^2$ in a spherical region where a distance from a midpoint of the discharge gap is within 0.6 mm.

2 Claims, 18 Drawing Sheets

SPARK PLUG AND IGNITION APPARATUS

CROSS-REFERENCE TO RELATED APPLICATIONS

This application is a division of U.S. patent application Ser. No. 09/960,514, filed Sep. 24, 2001, now U.S. Pat. No. 6,653,767 the entire content of which is hereby incorporated by reference in this application.

BACKGROUND OF THE INVENTION

The present invention relates to a spark plug and an ignition apparatus which are provided for an internal combustion engine of an automotive vehicle to ignite the fuel mixture introduced into a combustion chamber.

Conventionally known for improving the combustibility of fuel mixture is, for example, a multi-ignition technique using a plurality of spark plugs provided in the same combustion chamber or an intake air amount increasing technique using an intake port having an enlarged diameter.

According to these combustibility improving techniques, a very limited space is available for a spark plug. Under such circumstances, downsizing of spark plug as well as downsizing of ignition coil are keys to effectively utilize a limited combustion space.

An effective method for realizing the downsizing of spark plug and ignition coil is to reduce a discharge gap, i.e., a spatial clearance between a center electrode and a ground electrode disposed in an opposed relationship. This method is effective in reducing a discharge voltage, i.e., a voltage required for igniting fuel mixture.

However, according to the research and development of inventors of this invention, simply narrowing a discharge gap will result in worse ignitability of fuel mixture because the electrodes tend to obstruct the growth of a flame kernel caused in a narrowed discharge gap. In other words, the electrodes absorb the heat of a flame before the flame kernel grows sufficiently.

SUMMARY OF THE INVENTION

In view of the foregoing problems of the prior art, the present invention has an object to provide a spark plug that has a narrowed discharge gap but is capable of maintaining adequate ignitability and thus capable of realizing the downsizing of spark plug.

Furthermore, the present invention has an object to provide an ignition apparatus using this spark plug.

According to the inventors of the present invention, there is a tendency that the ignitability is significantly worsened in a discharge gap less than 1.1 mm. Knowing the difficulty in maintaining adequate ignitability in such a narrowed discharge gap, the inventors have zealously challenged to optimize the size (i.e., a diameter or the like) of the discharging electrodes for realizing an excellent spark plug capable of maintaining sufficient ignitability with a narrowed discharge gap.

To accomplish the above and other related objects, the present invention provides a first spark plug having a center electrode and a ground electrode spaced in an opposed relationship, wherein at least one of the center electrode and the ground electrode is made of an iridium alloy, a discharge gap between the center electrode and the ground electrode is less than 1.1 mm, and cross sections of the center electrode and the ground electrode are equal to or smaller than 0.95 $mm^2$ in a spherical region where a distance from a midpoint of the discharge gap is within 0.6 mm.

According to the first spark plug of the present invention, at least one of the center electrode and the ground electrode disposed in an opposed relationship is made of an iridium alloy. Due to its excellent durability, the iridium alloy can improve the durability of the spark electrode.

Furthermore, according to the intention of inventors, the first spark plug of the present invention is based on a downsized spark plug having a discharge gap less than 1.1 mm. As an optimized result, the inventors of the present invention have concluded that it becomes possible to maintain satisfactory ignitability when the cross sections of the center electrode and the ground electrode are equal to or smaller than 0.95 $mm^2$ in a spherical region where the distance from the midpoint of the discharge gap is within 0.6 mm.

According to a preferable embodiment, the cross section of the ground electrode is smaller than the cross section of the center electrode.

The flame kernel appears in a discharge gap and grows in a direction advancing toward a combustion chamber. In other words, the flame kernel encounters and collides with the ground electrode in the process of growth. In view of this fact, it is preferable that the cross section of the ground electrode is smaller than the cross section of the center electrode so as to prevent the ground electrode from obstructing the growth of flame.

The present invention provides a first ignition apparatus equipped with the above-described first spark plug, wherein an ignition power source is provided to apply a first voltage to one of the center electrode and the ground electrode which is made of an iridium alloy and to apply a second voltage higher than the first voltage to the other of the center electrode and the ground electrode.

According to a preferable embodiment, a negative electrode (i.e., one of the center electrode and the ground electrode) is made of an iridium alloy and a positive electrode (i.e., the other of the center electrode and the ground electrode) is made of an iridium alloy or other metal. Due to its small work function, the iridium alloy has a nature of easily releasing the electrons. Thus, forming the negative electrode by an iridium alloy makes it possible to cause electrons to easily depart from the negative electrode. Accordingly, it becomes possible to suppress or reduce a required discharge voltage. Thus, the present invention provides an ignition apparatus that is preferably employed to downsize an ignition coil.

Furthermore, according to a preferable embodiment of the first spark plug, the center electrode is rodlike and supported by a cylindrical metal fitting so that a distal end portion of the center electrode protrudes from one end of the metal fitting. The ground electrode is rodlike and fixed to a support member rigidly connected to the metal fitting. The support member has a proximal portion extending straight in parallel with an axis of the center electrode from the one end of the metal fitting and has a distal portion bent at a center of the support member and supporting the ground electrode. A free end of a ground electrode opposes to a side surface of the center electrode. And, the free end of the ground electrode is closest to the center electrode.

This arrangement is characterized in that the support member is bent at its center so that the free end of the ground electrode opposes to a side surface of the center electrode to form the discharge gap therebetween. Thus, it becomes possible to reduce the substantial length from the free end of the ground electrode to the metal fitting. The heat path extending along the support member is so short that heat of ground electrode can be smoothly released to the metal fitting. Ignitability can be adequately maintained. Furthermore, according to this arrangement, the free end of the rodlike ground electrode is closest to the center electrode. This arrangement makes a target of discharge clear and focused in a narrow region when seen from the center electrode. Ignitability can be improved.

Furthermore, the present invention provides a second spark plug having a center electrode and a ground electrode, wherein the ground electrode is a trapezoidal shape with a short side closer to the center electrode in a cross section normal to a central axis of the ground electrode. A length of the short side is in a range from 0.2 mm to 0.7 mm, and an apical angle of the trapezoidal shape at the short side is equal to or smaller than 135°.

According to the second spark plug, the short side of the trapezoidal ground electrode faces the center electrode so as to form a discharge gap therebetween. The length of the short side is in the range from 0.2 mm to 0.7 mm. A discharge surface thus formed is capable of suppressing the increase of discharge voltage without obstructing the growth of a flame kerne apical angle equal to or smaller than 135° at the short side of the trapezoidal ground electrode is effective to provide an adequate flame guide surface on the ground electrode inclined toward the combustion chamber. Thus, the flame kernel can expand smoothly along the slope of a trapezoidal ground electrode. Thus, the growth of flame kernel is optimized. The present invention provides a spark plug capable of assuring adequate ignitability and thereby realizing the downsizing of a spark plug even when a discharge gap is narrowed.

The present invention provides a third spark plug having a center electrode and a ground electrode spaced in an opposed relationship, wherein the ground electrode is made of a noble metallic alloy having a work function equal to or less than 5 eV, a discharge gap R1 is provided between the center electrode and the ground electrode, and a cross section of the ground electrode is equal to or smaller than 0.95 $mm^2$ in a spherical region where a distance R2 from a midpoint of the discharge gap R1 is within ½×R1+0.1 mm.

Thermoelectrons emitted from the ground electrode surround a discharging surface of the ground electrode. The electric field strength or intensity (i.e., gradient of electric potential) is locally increased in the vicinity of the discharging surface of the ground electrode. In other words, the distribution of discharge energy can be densified in the vicinity of the discharging surface of ground electrode. As a result, a flame kernel appears at an offset position closer to the ground electrode with respect to the midpoint of the discharge gap. As the cross section of the ground electrode is sufficiently small, the flame kernel can smoothly grow toward the center of the combustion chamber. Higher ignitability can be assured.

Furthermore, by forming the ground electrode by a noble metallic alloy having a work function equal to or less than 5 eV, and by restricting the cross section of the ground electrode to be equal to or smaller than 0.95 $mm^2$ in a predetermined region, it becomes possible to maintain the surface temperature of the ground electrode to a level capable of releasing the thermoelectrons even when the combustion gas temperature is low (for example, in an idling condition). Thus, the present invention can assure excellent ignitability of a spark plug in the entire engine driving conditions.

According to a preferable embodiment of the present invention, the center electrode and the ground electrode have cross sections in a range from 0.13 $mm^2$ to 0.5 $mm^2$ when positioned in the spherical region where the distance R2 from the midpoint is within ½×R1+0.1 mm.

This arrangement is effective to improve the heat and acid resistivity as well as the ignitability.

Furthermore, to eliminate impurities depositing between the center electrode and the ground electrode, it is preferable that the discharge distance R1 is equal to or larger than 0.3 mm.

It is also preferable that a ridge having a curvature radius equal to or less than 0.2 mm is provided at a distal end of the ground electrode.

An edge effect of the ridge enlarges the electric field strength in the vicinity of the distal end of the ground electrode.

It is also preferable that at least one of the center electrode and the ground electrode has a distal end configured into a spherical shape.

When a ratio of surface to volume of the electrode is small, it becomes possible to prevent the electrode from absorbing the heat of a flame.

Moreover, the present invention provides a second ignition apparatus equipped with the above-described second spark plug, wherein an ignition power source is provided to apply a positive voltage to the center electrode during an ignition discharge.

The thermoelectrons settling in the vicinity of the discharging surface of ground electrode have a function of locally decreasing the electric potential. Thus, it becomes possible to increase a substantial voltage applied between the center electrode and the ground electrode. The discharge operation can be stabilized.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF THE PREFERRED EMBODIMENTS

Figure 1:
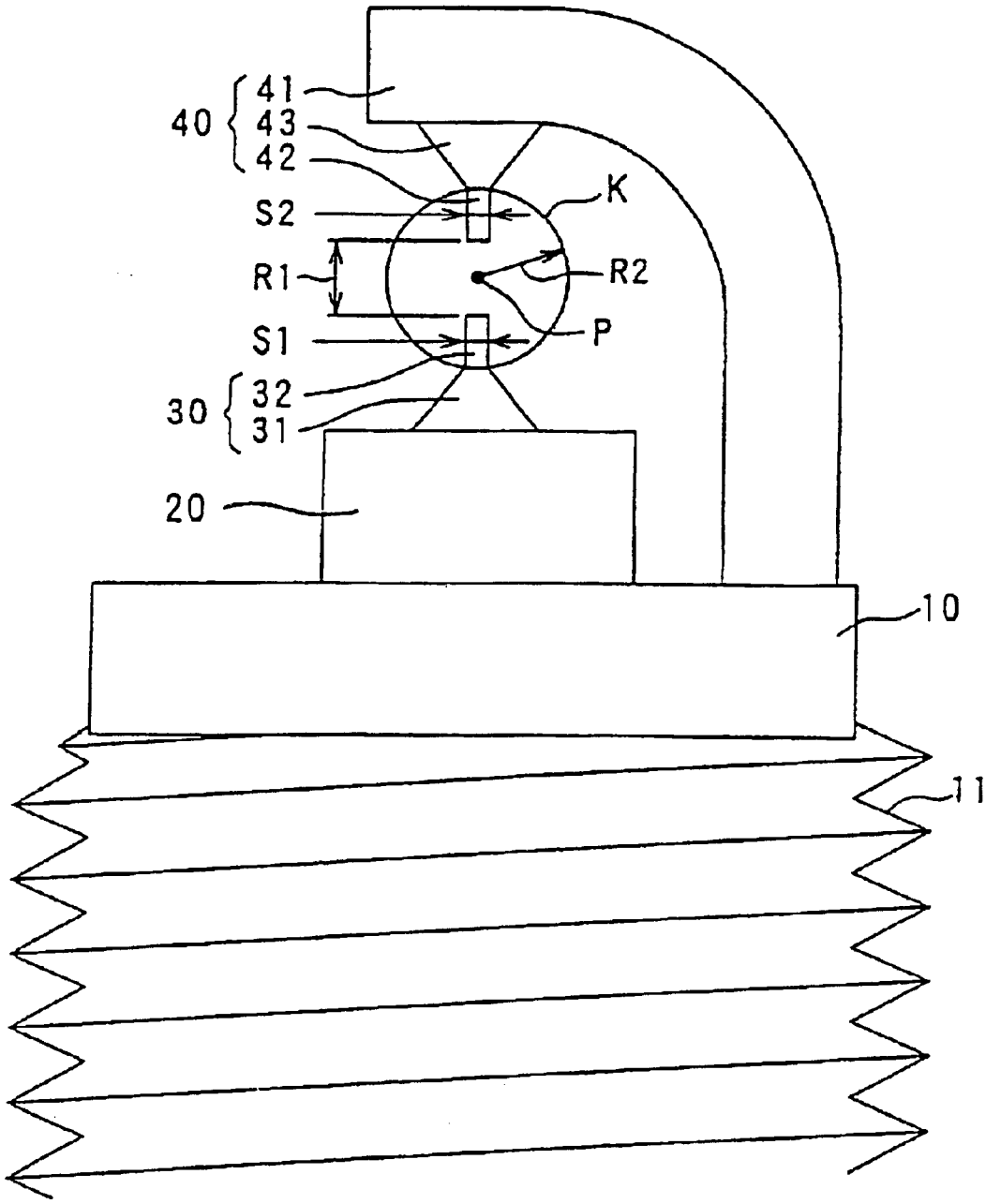
FIG. 1 is a diagram showing an essential arrangement of a spark plug in accordance with a first embodiment of the present invention.

Preferred embodiments of the present invention will be explained hereinafter with reference to attached drawings. Identical parts are denoted by the same reference numerals throughout drawings.

First Embodiment

FIG. 1 shows an essential arrangement of a spark plug in accordance with a first embodiment of the present invention. In FIG. 1, a metal fitting 10 is made of a carbon steel and configured into a cylindrical shape by cold forging or cutting operation. FIG. 1 discloses only one end of the metal fitting 10. The spark plug is fixed to an engine body by means of a screw portion 11 provided around the metal fitting 10.

A center electrode 30 is housed in an inside space of the cylindrical metal fitting 10. An insulator 20, interposed between the center electrode 30 and the inner wall of the metal fitting 10, electrically insulates the center electrode 30 from the metal fitting 10. The center electrode 30 is rodlike and extends in the axial direction of the spark plug, i.e., in the axial direction of the metal fitting 10. A distal end portion of the center electrode 30 protrudes from the metal fitting 10.

The distal end portion of the center electrode 30 consists of a base portion 31 made of a nickel alloy or the like and a tip 32 made of an iridium alloy. The tip 32 is welded directly on the base portion 31. The base portion 31, configured into a truncated conical body, has a conical or tapered surface expanding from a top of the base portion 31 to a bottom of the base portion 31. A top surface of base portion 31 is smaller than a bottom surface of the base portion 31. Both of the top surface and the bottom surface are normal to the axis of the center electrode 30. The tip 32 is configured into a cylindrical rod extending straight upward from the top of the base portion 31 in an axial direction of the spark plug.

A ground electrode 40 is provided in an opposed relationship with the tip 32 of the center electrode 30. The ground electrode 40 consists of a tip 42 made of an iridium alloy and configured into a cylindrical rod and a support member 41 made of a nickel alloy or the like. The support member 41 supports the tip 42.

The support member 41 is rodlike and is fixed at its proximal end to the metal fitting 10. A proximal portion of the support member 41 extends straight in parallel with the axis of the center electrode 30, i.e., in parallel with the axis of the spark plug, from the metal fitting 10. A distal portion of the support member 41 curves from an approximately center of the support member 41. A distal end of the support member 41 overhangs on the tip 32 (i.e., the distal end portion) of the center electrode 30.

Hereinafter, the tip 32 of center electrode 30 is referred to as a center electrode tip. The tip 42 of ground electrode 40 is referred to as a ground electrode tip.

The ground electrode tip 42 is welded to a surface of the support member 41 via a base portion 43 made of a nickel alloy or the like. The ground electrode tip 42 is opposed to the center electrode tip 32. The base portion 43 can be omitted, if possible.

The ground electrode tip 42 extends straight toward the center electrode tip 32 from the base portion 43. The center electrode tip 32 and the ground electrode tip 42 are disposed in an opposed relationship to form a discharge gap therebetween. In other words, these tips 32 and 42 are the most closely opposed portions of the center electrode 30 and the ground electrode 40.

The discharge gap R1, i.e., a distance between the center electrode tip 32 and the ground electrode tip 42, is less than 1.1 mm. A cross section S1 of the center electrode 30 and a cross section S2 of the ground electrode 40 are equal to or smaller than 0.95 $mm^2$ in a spherical region where a distance R2 from a midpoint P of the discharge gap R1 is within 0.6 mm.

A distance from the midpoint P to the center electrode tip 32 is equal to a distance from the midpoint P to the ground electrode 42. As shown in FIG. 1, a spherical surface K defines a boundary of the concerned space where the distance R2 from the midpoint P is within 0.6 mm. The center electrode tip 32 and the ground electrode 42 are completely included in the spherical space K.

In this respect, S1 represents a cross section of the center electrode tip 32 normal to the axis of the center electrode 30. S2 represents a cross section of the ground electrode tip 42 normal to the axis of the ground electrode 40. Both of the cross sections S1 and S2 are equal to or smaller than 0.95 $mm^2$. In other words, the center electrode tip 32 and the ground electrode tip 42 have a cross section whose diameter is equal to or smaller than 1.1 mm.

The above-described size range for the discharge gap R1 and for the cross sections S1 and S2 of the center electrode tip 32 and the ground electrode tip 42 are restricted based on the research and development conducted by the inventors. Hereinafter, the result of the conducted research and development will be explained in detail with reference to FIGS. 2 to 7.

A test piece used in this embodiment is a conventionally known spark plug having a center electrode of a cylindrical rodlike body opposed to a rectangular ground electrode configured into an L-shape rodlike body so as to form a discharge gap between them. Hereinafter, the effect of the center electrode brought by its construction will be described chiefly, as the similar effect was obtained for the ground electrode.

Figure 2:
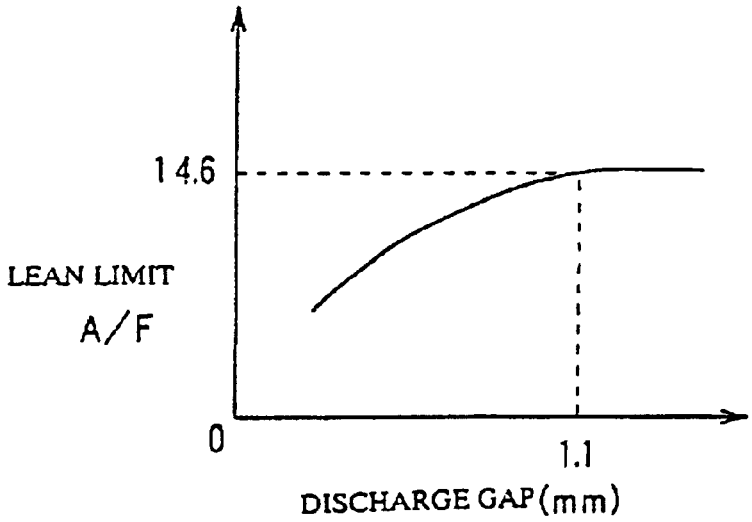
FIG. 2 is a graph showing a relationship between discharge gap and lean limit.

FIG. 2 shows a test result obtained with respect to a relationship between a discharge gap (mm) and a lean limit. The lean limit was used as an index expressing the ignitability. The lean limit is the most largest A/F value, i.e., an air-fuel ratio, capable of sustaining continuous combustion of fuel without causing any misfire. For example, the continuous combustion can be maintained when a combustion variability rate PmiCOV (%) is 15%. PmiCOV represents a ratio of a dispersion of mean effective pressure to an average value. In this respect, reduction of the lean limit leads to deterioration of ignitability.

Assuring a higher lean limit makes it possible to attain a required engine speed or a required engine power at a lean A/F (i.e., with the least consumption of fuel). In other words, it becomes possible to improve both of the fuel economy and the emission.

The center electrode of the tested spark plug has a diameter of 2.5 mm. The performance test was conducted at an idling speed (800 rpm) where the engine is subjected to severe combustion conditions. As understood from FIG. 2, when the discharge gap is equal to or larger than 1.1 mm, the lean limit is substantially saturated to 14.6. On the other hand, when the discharge gap is smaller than 1.1 mm, the lean limit becomes lower than 14.6 and therefore the ignitability is worsened in this region.

Figure 3:
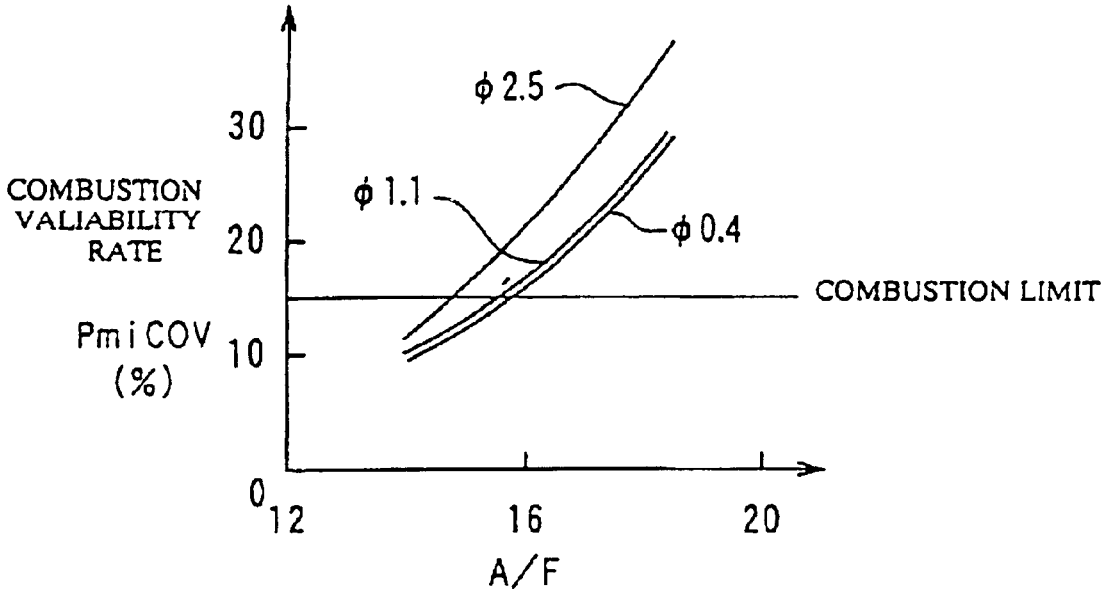
FIG. 3 is a graph showing a relationship between air-fuel ratio (i.e., A/F) and combustion variability rate for various electrode diameters.

FIG. 3 shows a test result obtained with respect to a relationship between A/F and combustion variability rate for three different diameters (ϕ2.5 mm, ϕ1.1 mm, ϕ0.4 mm) of the center electrode at the discharge gap of 0.8 mm.

Figure 4:
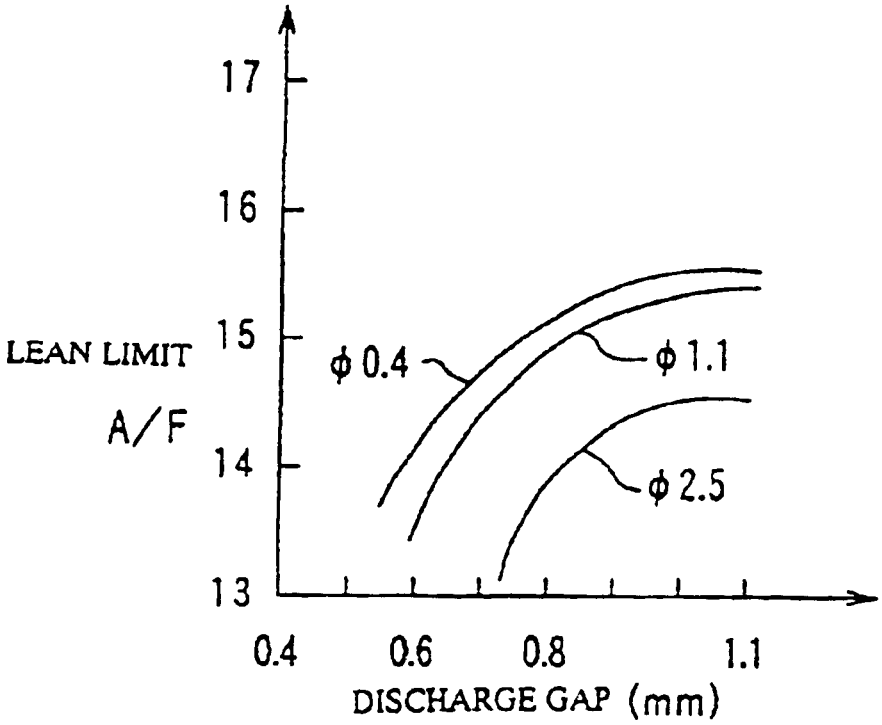
FIG. 4 is a graph showing a relationship between discharge gap and lean limit A/F for various electrode diameters.

FIG. 4 shows a test result obtained with respect to a relationship between a discharge gap (mm) and the lean limit A/F for the above-described three different diameters of the center electrode. As explained above, the lean limit A/F is an A/F value capable of sustaining continuous combustion without causing any misfire, more specifically, capable of attaining the combustion variability rate PmiCOV (%) of 15%. In obtaining the relationships shown in FIGS. 3 and 4, the tested engine was driven at an idling speed (800 rpm).

As understood from FIG. 3, when A/F is large, an increased difference in the center electrode diameter leads to a large difference in the combustion valiability rate.

As understood from FIG. 4, when the discharge gas is small, the lean limit is decreased and an increased difference in the center electrode diameter leads to a large difference in the lean limit A/F.

From the test results shown in FIGS. 3 and 4, it is understood that the lean limit decreases greatly in the case of ϕ2.5 mm compared with the case of ϕ1.1 mm. However, there is no substantial difference between the case of ϕ1.1 mm and the case of ϕ0.4 mm in the lean limit A/F. Hence, considering the lean limit as an index expressing the ignitability, an optimum relationship between the electrode diameter (mm) and the lean limit was sought by the inventors.

Figure 5:
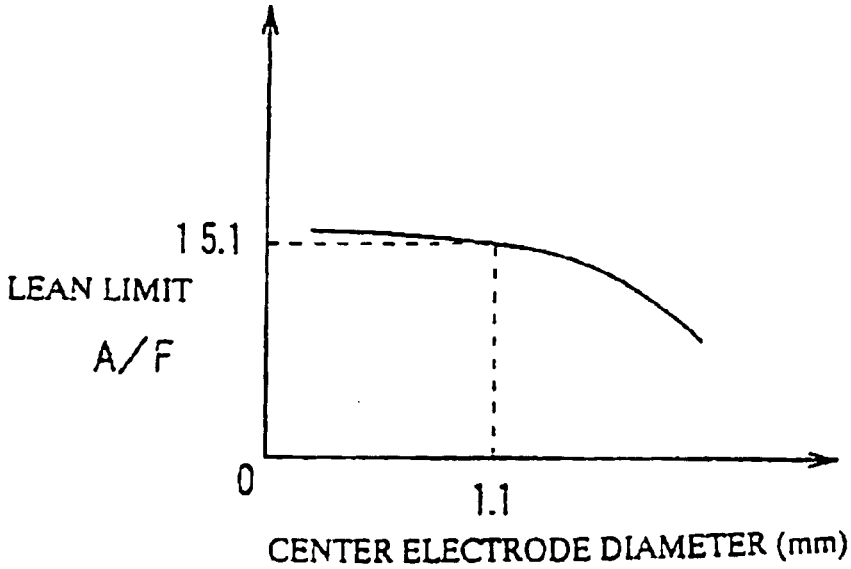
FIG. 5 is a graph showing a relationship between center electrode diameter and lean limit A/F.

FIG. 5 shows a relationship between the center electrode diameter (mm) and the lean limit A/F, obtained as a result of the test conducted on an engine driven at an idling speed (800 rpm) with a discharge gap of 0.8 mm. From the test result shown in FIG. 5, it is understood that the lean limit is stable when the center electrode diameter is equal to or smaller than 1.1 mm (cross section=0.95 $mm^2$).

Figure 6:
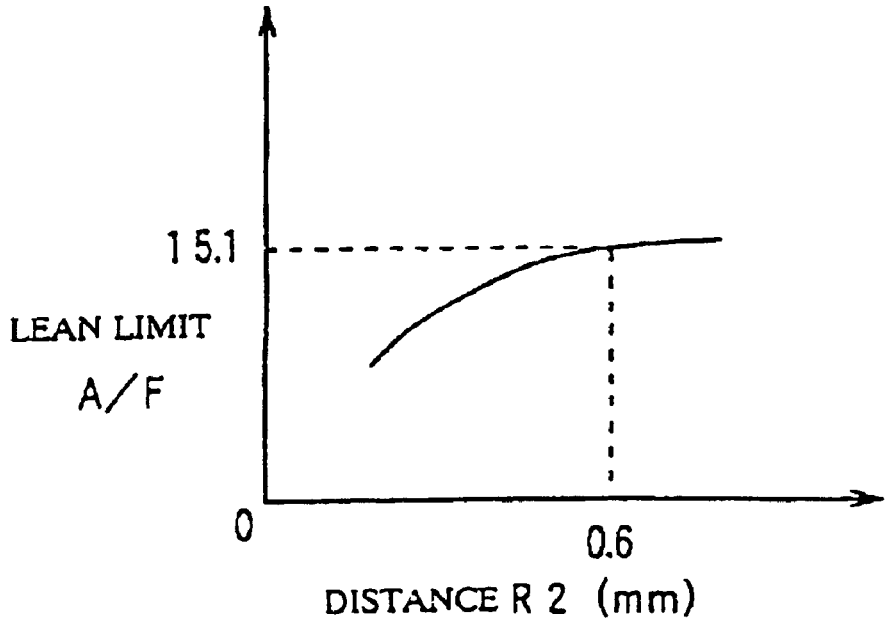
FIG. 6 is a graph showing a relationship between distance R2 and lean limit A/F.

FIG. 6 shows a relationship between the distance R2 and the lean limit A/F, obtained as a result of the test conducted on an engine driven at an idling speed (800 rpm) with a discharge gap of 0.8 mm. The electrode diameter was 1.1 mm.

From the result shown in FIG. 6, it is understood that the lean limit is substantially saturated to 15.1 when the distance R2 is equal to or larger than 0.6 mm. On the other hand, the lean limit becomes lower than 15.1 when the distance R2 is smaller than 0.6 mm and therefore the ignitability is worsened in this region. In other words, it can be concluded that the ignitability is significantly worsened when the electrode diameter is thicker than 1.1 mm in the spherical region where the distance R2 is within 0.6 mm.

Figure 7:
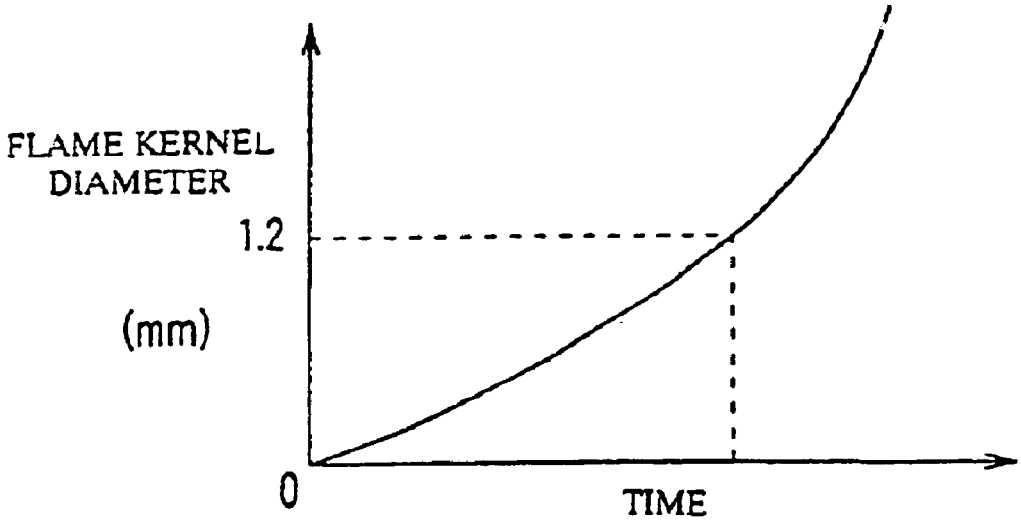
FIG. 7 is a graph showing a relationship between elapsed time and flame kernel diameter.

FIG. 7 shows a relationship between elapsed time and flame kernel diameter (mm), obtained through the growth of a flame kernel monitored on a practical engine. The flame kernel diameter represents a size (diameter) of a flame produced when a fuel mixture is ignited by a spark plug.

From FIG. 7, it is understood that the flame grows rapidly after the flame kernel diameter exceeds 1.2 mm. The tendency shown in A was commonly recognized for various A/F conditions, although the time required for the flame kernel diameter to reach 1.2 mm is dependent on the A/F conditions.

As a conclusion derived from the results of FIGS. 6 and 7, it is preferable that the electrode diameter is equal to or smaller than 1.1 mm (equivalent to 0.95 $mm^2$ in terms of cross section) in a spherical region where the distance R2 from the midpoint P of the discharge gap R1 is within 0.6 mm.

As described above, according to this embodiment, each of the center electrode 32 and the ground electrode 42 is made of an iridium alloy having excellent durability. Thus, it becomes possible to improve the durability of these electrodes. However, improving the durability of spark plug electrodes can be attained by forming at least one of the center electrode 32 and the ground electrode 42 by an iridium alloy.

Furthermore, the above-described embodiment is based on a downsized spark plug having the discharge gap R1 less than 1.1 mm. The inventors of the present invention have concluded, as an optimized result, that it becomes possible to maintain satisfactory ignitability when the cross sections S1 and S2 of the center electrode 32 and the ground electrode 42 are equal to or smaller than 0.95 $mm^2$ (equivalent to 1.1 mm in terms of electrode diameter) in a spherical region where the distance R2 from the midpoint P of the discharge gap R1 is within 0.6 mm. The electrode satisfying this condition is sufficiently thin and therefore does not obstruct the growth of a flame kernel. Thus, it becomes possible to maintain adequate ignitability.

As apparent from the foregoing description, the first embodiment provides a spark plug capable of assuring the ignitability even when the discharge gap is reduced to realize the downsizing of the spark plug.

The diameters of the center electrode tip 32 and the ground electrode tip 42 can be equal to or different from each other.

If any one of the base portion 31 of center electrode 30, the base portion 43 of around electrode 40, and the support member 41 is positioned within the spherical region defined by the distance R2=0.6 mm, the corresponding portion should be cut into a smaller size so as to have a cross section equal to or smaller than 0.95 $mm^2$.

Second Embodiment

Figure 8:
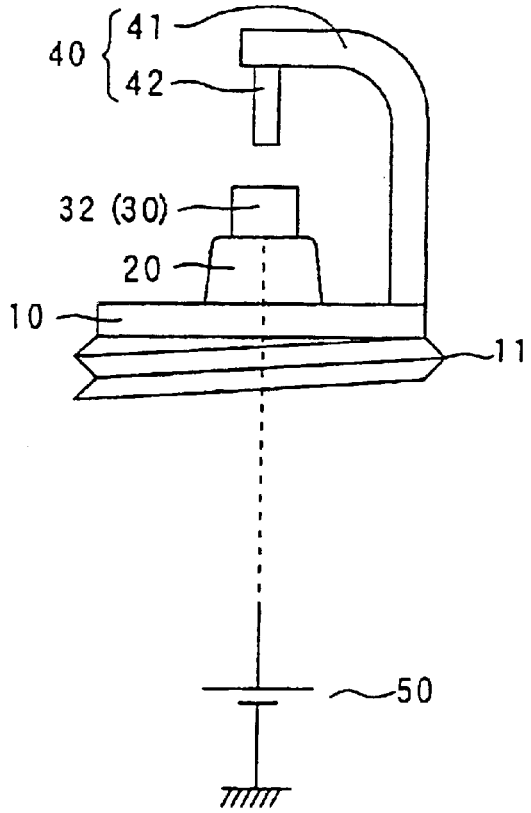
FIG. 8 is a diagram showing an essential arrangement of a spark plug in accordance with a second embodiment of the present invention.

FIG. 8 shows an essential arrangement of a spark plug in accordance with a second embodiment of the present invention.

The spark plug shown in FIG. 8 is characterized in that a diameter of the ground electrode tip 42 is smaller than that of the center electrode 32.

The ground electrode tip 42, i.e., an opposed portion of the ground electrode 40, is made of an iridium alloy. The center electrode tip 32 is made of a platinum alloy. However, the center electrode tip 32 can be made of an iridium alloy.

According to this embodiment, the discharge gap between the center electrode 30 and the ground electrode 40 is equal to or smaller than 1.1 mm and the cross sections of these electrodes 30 and 40 are equal to or smaller than 0.95 $mm^2$ in a spherical region where the distance R2 from the midpoint P of the discharge gap R1 is within 0.6 mm.

An ignition power source 50 is provided to cause a discharge between the center electrode tip 32 and the ground electrode tip 42. A voltage applied to the ground electrode tip 42 is lower than a voltage applied to the center electrode tip 32. More specifically, the ignition power source 50 applies a positive voltage to the center electrode tip 32, while the ground electrode tip 42 is grounded. In this respect, the ignition power source 50 applies a first voltage to an electrode which is made of an iridium alloy and applies a second voltage higher than the first voltage to the other electrode.

The ground electrode 40 is subjected to high temperatures as it is located closely to the center of a combustion chamber compared with the center electrode 30. A discharge, occurring in the gap between the center electrode tip 32 and the ground electrode tip 42, separates the particles into electrons and positive ions. As a positive voltage is applied to the center electrode 30, electrons collide with the center electrode tip 32 while positive ions collide with the ground electrode tip 42.

The mass of a positive ion is larger than that of an electron. Therefore, there is a tendency that the ground electrode tip 42 is worn hardly by the positive ions.

In view of the foregoing, the ground electrode tip 42 must be durable or resistive against heat and wear. This is why the ground electrode tip 42 is made of an iridium alloy.

A flame kernel, caused in the discharge gap between the center electrode tip 32 and the ground electrode tip 42, grows in a direction advancing toward the center of the combustion chamber. Thus, the ground electrode tip 42 encounters with a growing flame kernel. However, according to the second embodiment, the ground electrode tip 42 is thinner than the center electrode tip 32. It becomes possible to prevent the ground electrode tip 42 from obstructing the growth of flame kernel as much as possible.

According to the second embodiment, the ground electrode 40 having an iridium alloy tip is grounded and a positive voltage is applied to the center electrode 30 opposed to the ground electrode 40. The iridium alloy has a small work function, and therefore has a nature of easily releasing the electrons. This is effective to stabilize the spark of discharge and reduce a discharge voltage.

Third Embodiment

Figure 9:
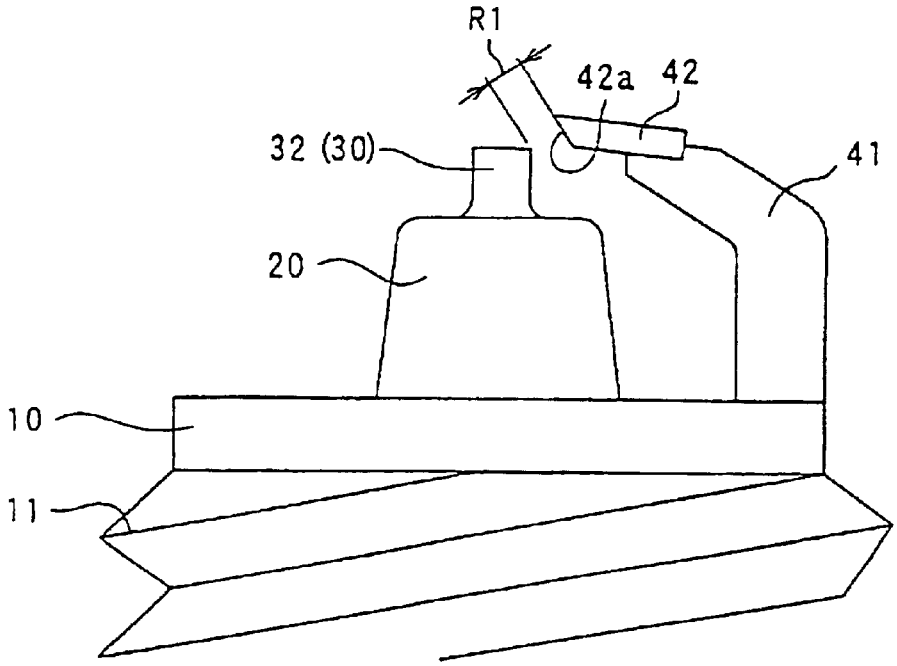
FIG. 9 is a diagram showing an essential arrangement of a spark plug in accordance with a third embodiment of the present invention.

FIG. 9 shows an essential arrangement of a spark plug in accordance with a third embodiment of the present invention.

The spark plug shown in FIG. 9 is characterized in that the ground electrode and its support member are modified from those of the spark plug disclosed in FIG. 8.

More specifically, a ground electrode tip 42 is rodlike and fixed to the one end of the cylindrical metal fitting 10 via a rodlike support member 41. The support member 41 has a proximal portion extending straight in parallel with an axis of the center electrode 30 (i.e., center electrode tip 32) from the metal fitting 10 and has a distal portion bent at a center of the support member 41 so that a free end 42*a* of the ground electrode tip 42 opposes to a side surface of the center electrode 30. And, the free end 42*a* of the ground electrode tip 42 is closest to the center electrode 30.

The other end of the ground electrode tip 42 is welded to the support member 41. The free end 42*a* of the ground electrode tip 42 is oblique with respect to the axis of the ground electrode tip 42. A discharge gap R1 is formed between the center electrode tip 32 and the oblique or slant surface of the free end 42*a* of the ground electrode tip 40.

According to this embodiment, the discharge gap between the center electrode and the ground electrode is equal to or smaller than 1.1 mm and the cross sections of these electrodes are equal to or smaller than 0.95 $mm^2$ in a spherical region where the distance R2 from the midpoint P of the discharge gap R1 is within 0.6 mm.

The arrangement of this embodiment is characterized in that the rodlike support member 41 is bent at its center so that the free end 42*a* of the ground electrode tip 42 opposes to a side surface of the center electrode tip 32 to form the discharge gap R1. Thus, it becomes possible to reduce the substantial length from the free end 42*a* of the ground electrode tip 42 to the metal fitting 10.

Thus, according to this embodiment, the heat path extending along the support member 41 from the ground electrode 42 to the metal fitting 10 is so short that heat of ground electrode 42 can be smoothly released to the metal fitting 10. Ignitability can be adequately maintained.

Furthermore, according to this embodiment, the free end 42*a* of the rodlike ground electrode tip 42 is closest to the center electrode tip 32. This arrangement makes a target of discharge clear and focused in a narrow region when seen from the center electrode. Ignitability can be improved.

Fourth Embodiment

Figure 10B:
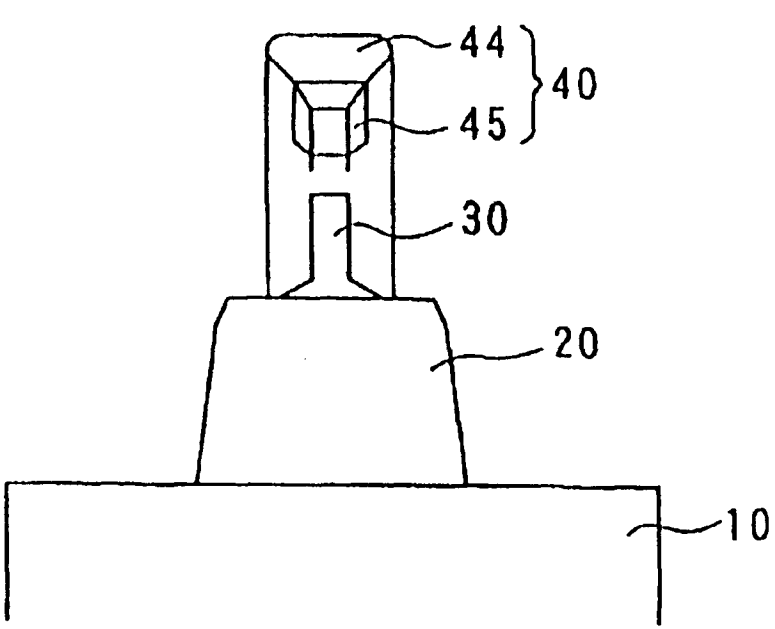
FIGS. 10A and 10B are diagrams showing an essential arrangement of a spark plug in accordance with a fourth embodiment of the present invention.
Figure 10A:
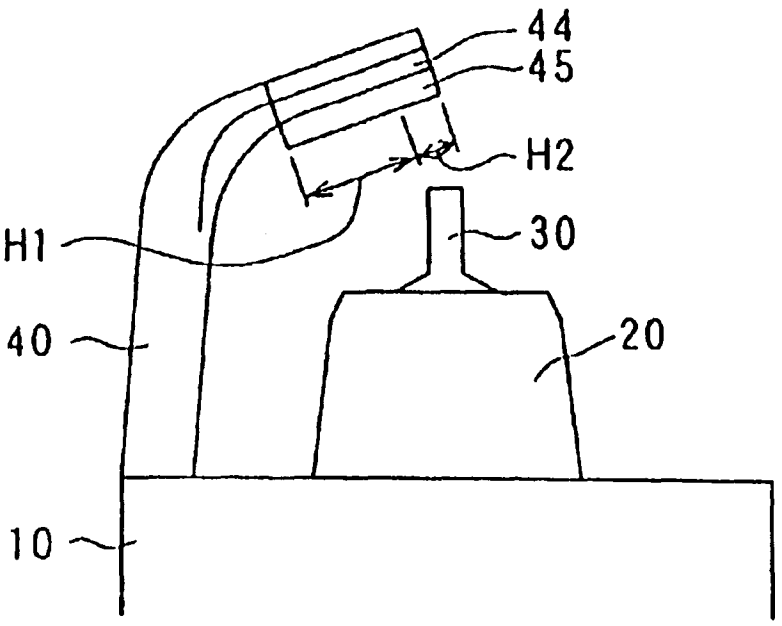

FIGS. 10A and 10B show an essential arrangement of a spark plug in accordance with a fourth embodiment of the present invention. FIG. 10B is a right side view of FIG. 10A.

A center electrode 30 and a ground electrode 40 are disposed in an opposed or confronting relationship. The ground electrode 40, configured into a rodlike body and curved at its center, has a proximal end fixed to the metal fitting 10. A distal end of the ground electrode 40, opposing to the center electrode 30, is equipped with an iridium alloy tip 45 welded to a nickel alloy portion 44.

A distal end portion of the center electrode 30, opposing to the ground electrode 40, is made of an iridium alloy or the like and configured into a columnar shape with a diameter of 0.7 mm or less (e.g., 0.4 mm). A clearance formed between the distal end portion of the center electrode 30 and the iridium alloy tip 45 serves as a discharge gap in a range from 0.4 mm to 1.2 mm.

Figure 11A:
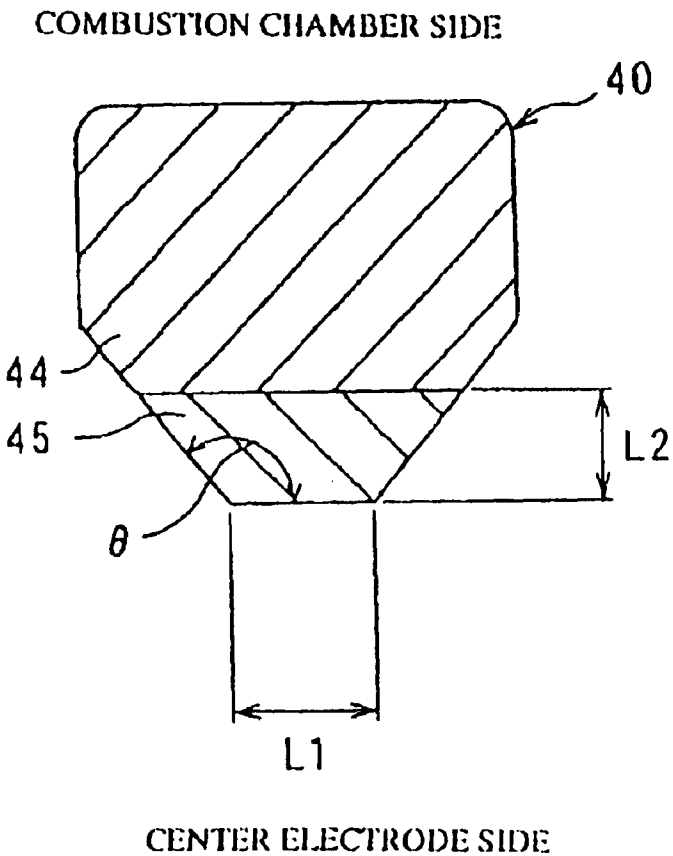
FIGS. 11A and 11B are cross-sectional diagrams showing a ground electrode of the spark plug in accordance with the fourth embodiment, taken along a plane normal to a central axis of the ground electrode.
Figure 11B:
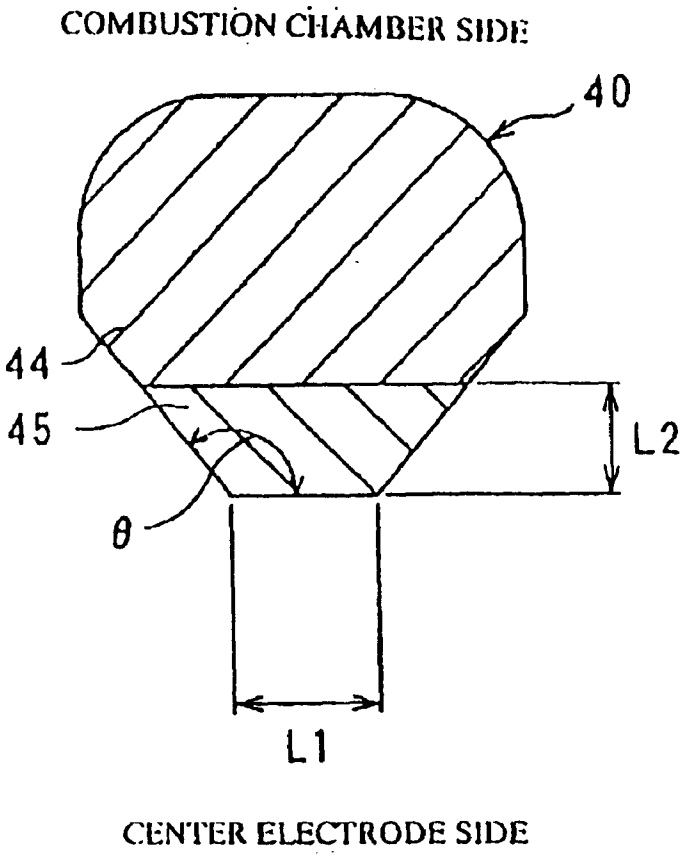

The ground electrode 40 has a cross section shown in FIG. 11A or 11B. Each cross section shown in FIGS. 11A and 11B, taken along a plane normal to the central axis of the ground electrode 40, has a trapezoidal shape with a short side closer to the center electrode 30. The length L1 of the short side is in a range from 0.2 mm to 0.7 mm, and an apical angle θ at the short side of the trapezoidal shape is equal to or smaller than 135°.

The iridium alloy tip 45 extends from the short side of the trapezoidal shape toward a long side of the trapezoidal shape so as to have a depth L2 in the range from 0.3 mm to 1.0 mm.

The long side of the trapezoidal shape, facing the combustion chamber, has rounded corners at both edges with appropriate curvatures as shown in FIGS. 11A and 11B.

The ground electrode 40 can be formed in a range H1 and a range H2 shown in FIG. 10A. The origin of the distances H1 and H2 resides on a position closest to the center electrode 30. The distance H1 extends from this origin toward the proximal end of the ground electrode 40, while the distance H2 extends from the origin to the distal end of the ground electrode 40. values of the distances H1 and H2 are equal to or smaller than 3 mm.

The shortest distance from the ground electrode 40 to the center electrode 30, i.e., discharge gap, is in the range from 0.4 mm to 1.2 mm. The longest distance from the ground electrode 40 to the center electrode 30 can be set to a value larger than the discharge gap by 0.1 mm to 0.3 mm.

According to this embodiment, a flame kernel produced in the discharge gap can expand or grow smoothly along the slope of a trapezoidal ground electrode with the apical angle θ at the short side being equal to or smaller than 135°.

Hereinafter, a mechanism for promoting or facilitating the growth of flame kernel will be explained with reference to FIGS. 12A and 12B.

Figure 12B:
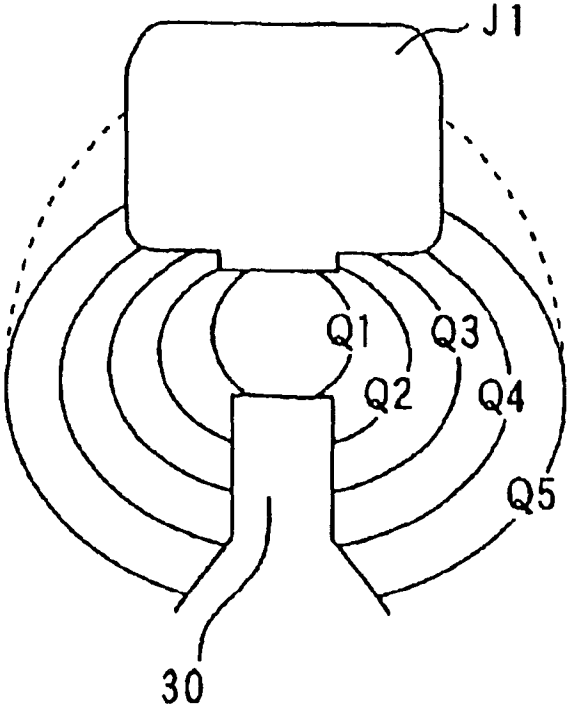
FIGS. 12A and 12B are diagrams explaining the growth of flame kernel in accordance with the fourth embodiment of the present invention.
Figure 12A:
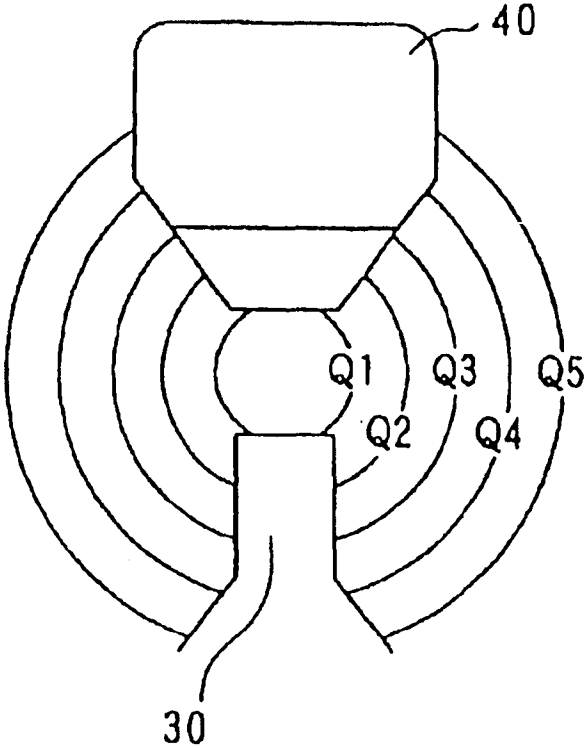

In FIGS. 12A and 12B, circular lines Q1 to Q5 are flame patterns showing instantaneous flame surfaces observed at predetermined time intervals. The flame kernel grows successively in the order of Q1→Q2→Q3→Q4→Q5. As apparent from the drawings, the growth of flame kernel is very smooth in the case of FIG. 12A (this embodiment) compared with the case of FIG. 12B (comparative example).

Furthermore, according to this embodiment, the short side of the trapezoidal ground electrode 40 faces the center electrode 30 so as to form a discharge gap therebetween. The length L1 of the short side is in the range from 0.2 mm to 0.7 mm. A discharge surface thus formed is capable of suppressing the increase of discharge voltage without obstructing the growth of a flame kernel.

If the length L1 is less than 0.2 mm, a target of discharge on the ground electrode 40 becomes so small when seen from the center electrode 30. This will induce the increase of discharge voltage. On the other hand, if the length L1 is larger than 0.7 mm, the growth of flame kernel will be obstructed by the ground electrode 40.

Furthermore, according to this embodiment, the apical angle θ at the short side of the trapezoidal ground electrode 40 is equal to or smaller than 135°. With this arrangement, it becomes possible to provide an oblique surface on the ground electrode 40 inclined at an angle equal to or larger than 45° toward the combustion chamber. Thus, the flame kernel grows smoothly.

In view of the foregoing, the fourth embodiment can provide a spark plug capable of assuring adequate ignitability even when a discharge gap is narrowed, thereby realizing the downsizing of the spark plug.

Fifth Embodiment

Figure 13:
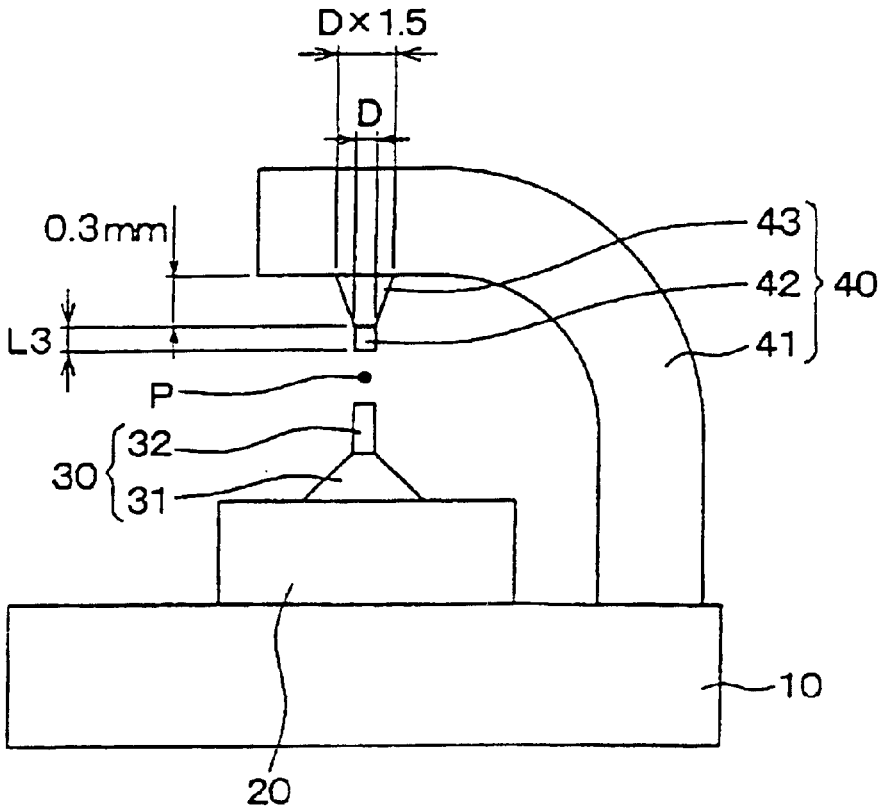
FIG. 13 is a diagram showing an essential arrangement of a spark plug in accordance with a fifth embodiment of the present invention.
Figure 14:
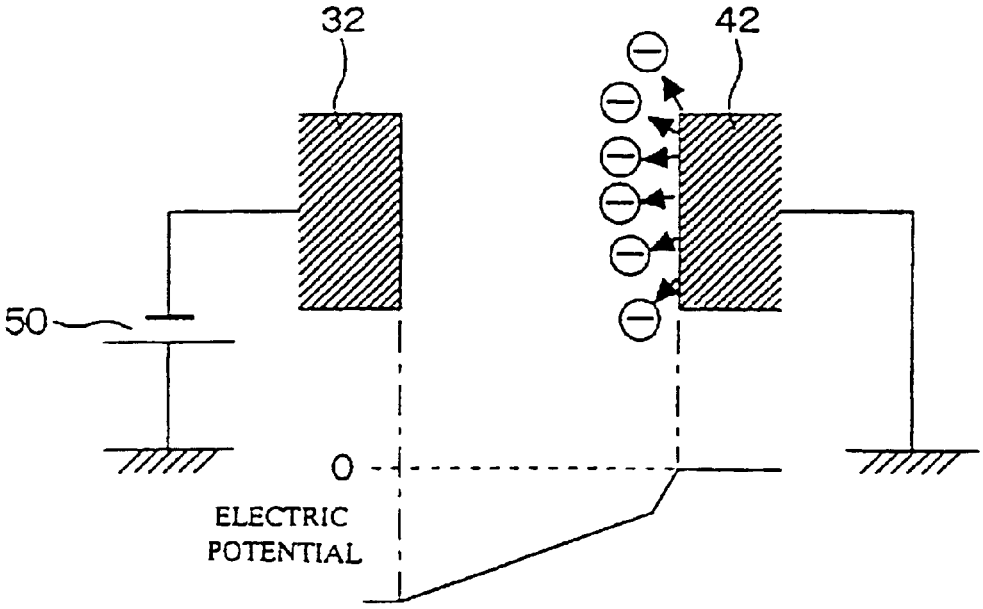
FIG. 14 is a diagram showing an essential arrangement of an ignition apparatus using the spark plug shown in FIG. 13.

FIG. 13 shows an essential arrangement of a spark plug in accordance with a fifth embodiment of the present invention. FIG. 14 shows an ignition apparatus using the spark plug shown in FIG. 13.

The spark plug shown in FIG. 13 is substantially identical with the spark plug of the first embodiment in its structure as well as in the materials used in it. A ground electrode tip 42 of the fifth embodiment is made of a noble metallic alloy (e.g., iridium alloy) having a work function equal to or less than 5 eV. An ignition power source 50 shown in FIG. 14 provides a negative voltage to the center electrode 30 (i.e., center electrode tip 32), while the ground electrode 40 (i.e., ground electrode tip 42) is grounded. A discharge is caused between the center electrode tip 32 and the ground electrode tip 42 which are opposed coaxially.

According to the arrangement of this embodiment, a flame kernel appears from an offset position closer to the ground electrode tip 42 with respect to the midpoint P of the discharge gap. In other words, the fifth embodiment can promote or facilitate the growth of a flame kernel by letting the flame kernel appear closely to the center of the combustion chamber.

The ground electrode tip 42 emits thermoelectrons from its surface (i.e., discharging surface opposed to the center electrode tip 32). This is effective to increase the electric field strength or intensity (i.e., gradient of electric potential) in the vicinity of the discharging surface of ground electrode tip 42. In other words, the distribution of discharge energy can be densified in the vicinity of the discharging surface of ground electrode tip 42.

Figure 15:
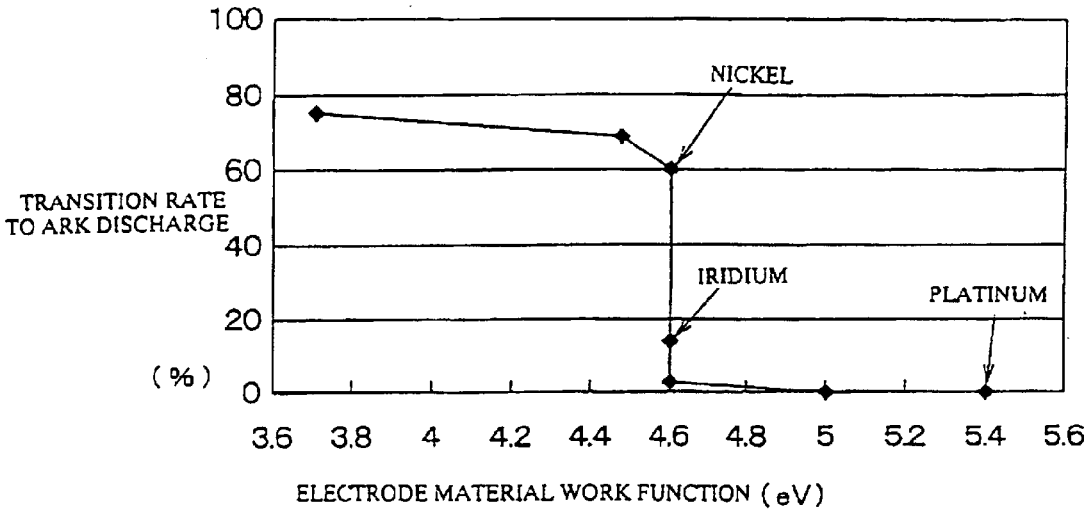
FIG. 15 is a graph showing a relationship between work function of electrode material and ratio of transition from glow discharge to ark discharge.

FIG. 15 shows a relationship between work function of electrode material and ratio of transition from glow discharge to ark discharge. The transition from glow discharge to ark discharge is dependent on release of thermoelectrons from the electrode. No transition is found in a platinum electrode having a work function of 5.4 eV. The transition is found in an electrode material having a work function equal to or less than 5 eV. The ratio of transition increases when the electrode is made of an iridium or nickel material having a work function of 4.6 eV.

From the relationship show in FIG. 15, forming the ground electrode tip 42 by a noble metallic alloy having a work function equal to or smaller than 5 eV is effective to cause the ground electrode tip 42 to emit thermoelectrons from its surface (i.e., the discharging surface opposed to the center electrode tip 32). It becomes possible to locally densify the distribution of discharge energy in the vicinity of the surface of the ground electrode tip 42.

The inventors of this invention have further conducted the research and development with respect to the possibility of increasing the surface temperature of the ground electrode tip 42 to a level capable of releasing the thermoelectrons even when the combustion gas temperature is low (for example, in an idling condition). In the case of a noble metallic alloy having a work function equal to or smaller than 5 eV, it is necessary to maintain 730° C. to assure active release of thermoelectrons.

Figure 16:
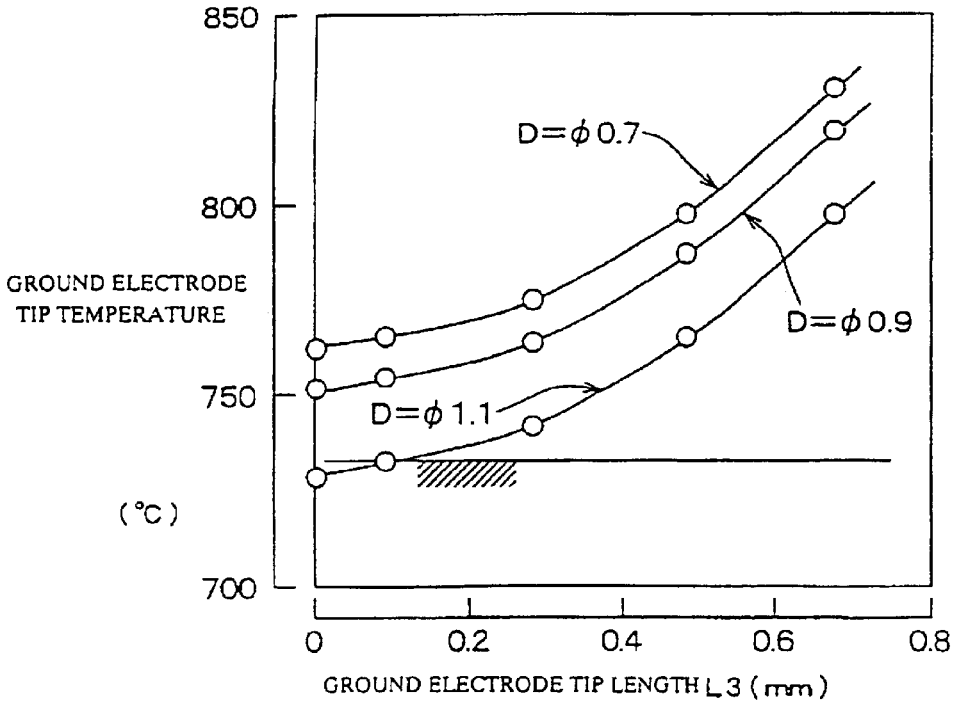
FIG. 16 is a graph showing an attainable surface temperature of a ground electrode in connection with the parameters of tip length L3 and tip diameter D of the ground electrode.

FIG. 16 is a simulation result showing an attainable surface temperature at the distal end of the ground electrode tip 42 in connection with the parameters of length L3 and diameter D of the ground electrode tip 42. The conditions of this simulation is as follows: a length of the base portion 43 is 0.3 mm, a diameter of the base portion 43 is 1.5 times the diameter D of the ground electrode tip 42, the combustion gas temperature at an idling speed is 900° C., and a heat transfer coefficient between the combustion gas and the ground electrode tip 42 is $4.5\times10^{-4}$ W/mm$^{2}$° C.

As apparent from FIG. 16, the surface temperature of the distal end of ground electrode tip 42 can be maintained to a level equal to or larger than 730° C. at the idling speed when the diameter D of the ground electrode tip 42 is equal to or less than 1.1 mm (equivalent to 0.95 mm$^2$ in terms of cross section) and the length L3 of the ground electrode tip 42 is equal to or larger than 0.1 mm.

In other words, the surface temperature of the distal end of ground electrode tip 42 can be maintained to a level equal to or larger than 730° C. at the idling speed when a cross section of the ground electrode tip 42 is equal to or smaller than 0.95 mm$^2$ in a spherical region where the distance R2 from the midpoint P of the discharge gap R1 is within ½×R1+0.1 mm.

Furthermore, by forming the ground electrode tip 42 by a noble metallic alloy having a work function equal to or less than 5 eV, and by restricting the cross section of the ground electrode tip 42 to be equal to or smaller than 0.95 mm$^2$ in a predetermined region distant by 0.1 mm from the distal end of the ground electrode tip 42, it becomes possible to maintain the surface temperature of the ground electrode tip 42 to a level capable of releasing the thermoelectrons even when the combustion gas temperature is low (for example, in an idling condition). Thus, this embodiment can assure excellent ignitability of a spark plug in the entire engine driving conditions.

To maintain a higher surface temperature at the distal end of ground electrode tip 42, it is desirable to limit a diameter of the base portion 43 within 1.5 times the diameter D of ground electrode tip 42. For example, when D is 1.1 mm, a desirable diameter of the base portion 43 is equal to or less than 1.65 mm (equivalent to 2.14 mm$^2$ in terms of cross section).

Sixth Embodiment

Figure 17B:
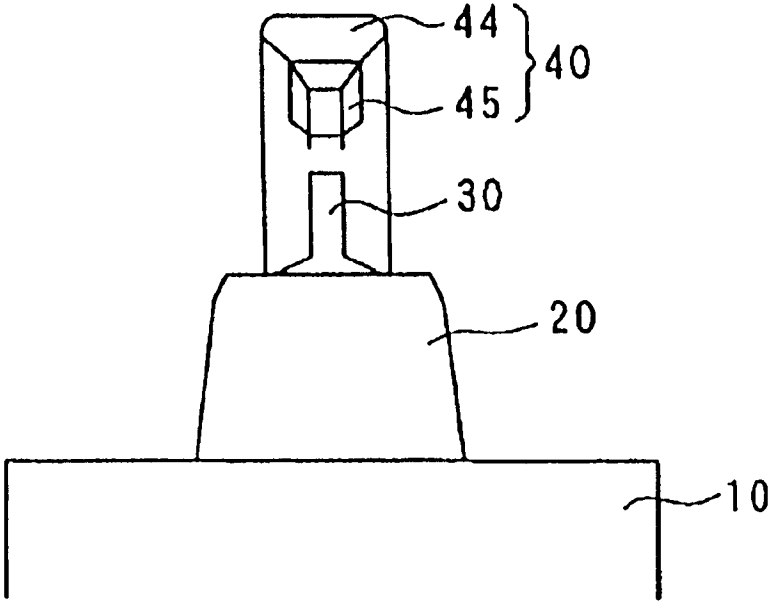
FIGS. 17A and 17B are cross-sectional diagrams showing a spark plug in accordance with a sixth embodiment of the present invention.
Figure 17A:
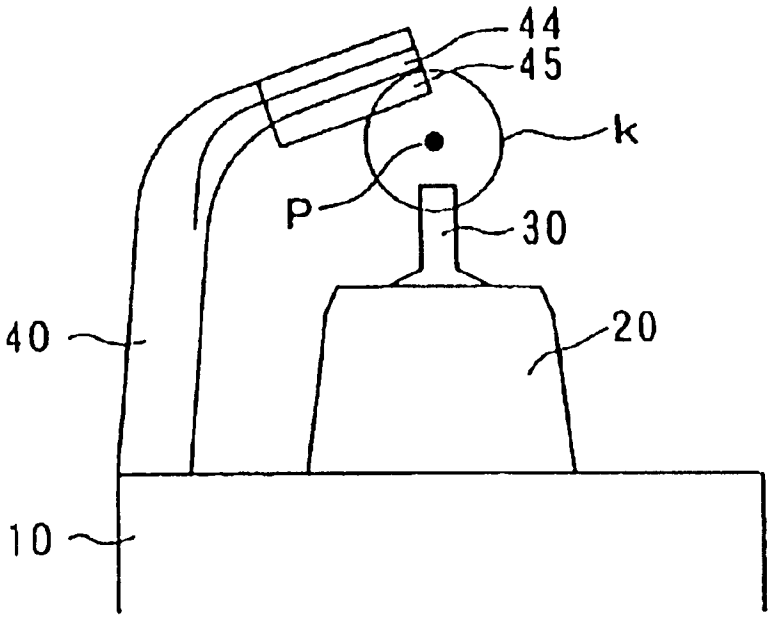
Figure 18:
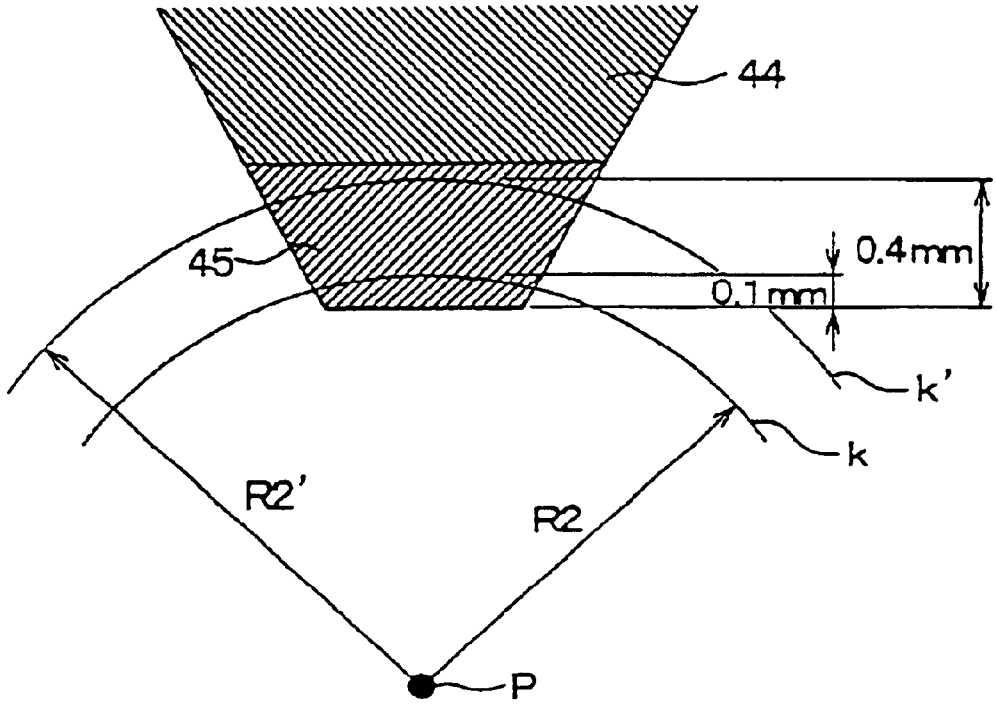
FIG. 18 is a cross-sectional view showing a ground electrode of the spark plug in accordance with the sixth embodiment, taken along a plane normal to a central axis of the ground electrode.

FIGS. 17A, 17B and 18 show an essential arrangement of a spark plug in accordance with a sixth embodiment of the present invention. The spark plug of the sixth embodiment differs from the spark plug of the fifth embodiment in that the ground electrode 40 (i.e., ground electrode tip 45) has a trapezoidal cross section. FIG. 17B is a right side view of FIG. 17A. FIG. 18 shows a cross section of the ground electrode 40 taken along a plane normal to a central axis of the ground electrode 40.

The ground electrode 40, configured into a rodlike body and curved at its center, has a proximal end fixed to the metal fitting 10. A distal end of the ground electrode 40, opposing to a center electrode 30, is equipped with an iridium alloy tip 45 welded to a nickel alloy portion 44.

As shown in FIG. 18, when seen in a cross section taken along a plane normal to the central axis of the ground electrode 40, the ground electrode 40 has a trapezoidal shape with a short side closer to the center electrode 30.

The ground electrode tip 45 has a cross-sectional area equal to or less than 0.95 mm$^2$ (equivalent to a cylindrical rod with a diameter 1.1 mm) when taken along a spherical surface "k" passing a point deeper by 0.1 mm than a discharging surface of the ground electrode tip 45. The spherical surface "k" is distant by R2 (=½×R1+0.1 mm) from the midpoint P of the discharge gap R1.

Furthermore, the ground electrode tip 45 has a cross-sectional area equal to or less than 2.14 mm$^2$ (equivalent to a cylindrical rod with a diameter 1.65 mm) when taken along a spherical surface "k" passing a point deeper by 0.4 mm than the discharging surface of the ground electrode tip 45. The spherical surface "k" is distant by R2' (=½×R1+0.4 mm) from the midpoint P of the discharge gap R1.

According to the sixth embodiment, it becomes possible to maintain the surface temperature of the ground electrode tip 45 to a level capable of releasing the thermoelectrons even when the combustion gas temperature is low (for example, in an idling condition). Thus, this embodiment can assure excellent ignitability of a spark plug in the entire engine driving conditions.

Seventh Embodiment

Figure 19:
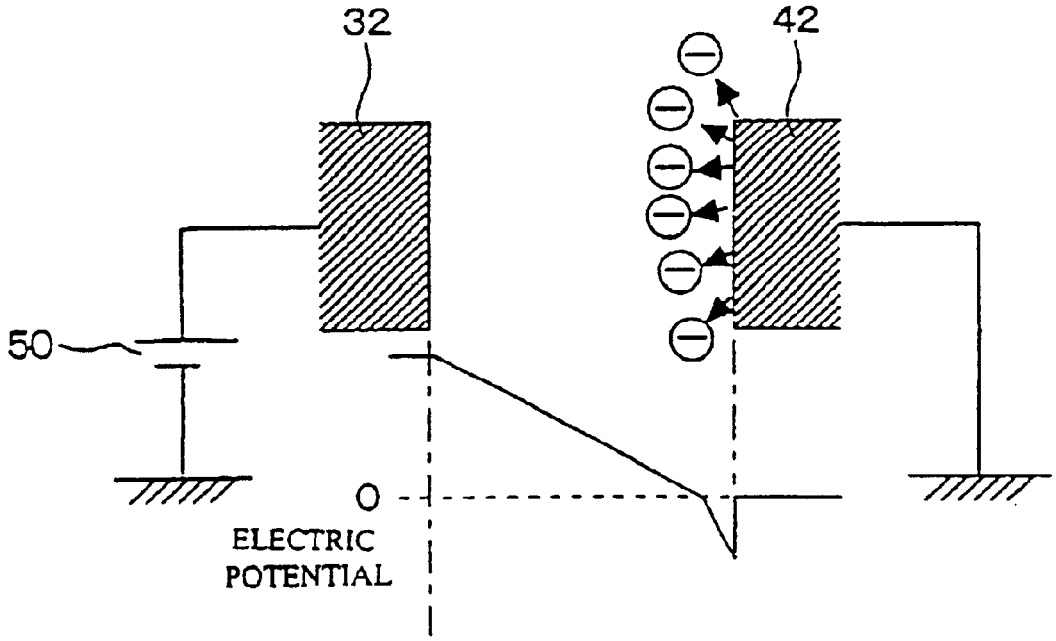
FIG. 19 is a diagram showing an essential arrangement of an ignition apparatus in accordance with a seventh embodiment of the present invention.

FIG. 19 shows an essential arrangement of an ignition apparatus in accordance with a seventh embodiment of the present invention.

An ignition power source 50 shown in FIG. 19 differs from the ignition power source 50 of the fifth embodiment in that a positive voltage is applied to the center electrode 30 (i.e., center electrode tip 32), while the ground electrode 40 (i.e., ground electrode tip 42) is grounded. A discharge is caused between the center electrode tip 32 and the ground electrode tip 42 which are opposed coaxially.

According to the arrangement of this embodiment, the ground electrode tip 42 emits thermoelectrons from its surface (i.e., discharging surface opposed to the center electrode tip 32). This is effective to increase the electric field strength (i.e., gradient of electric potential) in the vicinity of the discharging surface of ground electrode tip 42. In other words, the distribution of discharge energy can be densified in the vicinity of the discharging surface of ground electrode tip 42.

Furthermore, the thermoelectrons settling in the vicinity of the discharging surface of ground electrode tip 42 have a function of decreasing the electric potential locally in the vicinity of the ground electrode tip 42. Thus, it becomes possible to increase a substantial voltage applied between the electrodes 32 and 42. The discharge operation can be stabilized.

Eighth Embodiment

Figure 20:
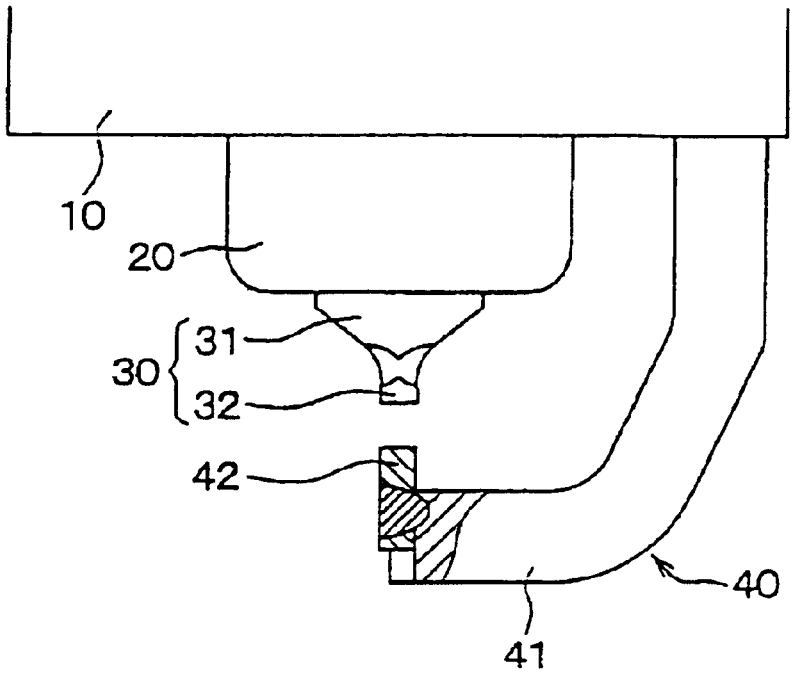
FIG. 20 is a diagram showing an essential arrangement of a spark plug in accordance with an eighth embodiment of the present invention.

FIG. 20 shows an essential arrangement of a spark plug in accordance with an eighth embodiment of the present invention.

The spark plug of the eighth embodiment differs from the spark plug of the fifth embodiment in that a ground electrode tip 42 is welded on a distal end of a rodlike support member 41. The ground electrode tip 42 is opposed to a center electrode tip 32 in an axial direction of the center electrode 30.

Ninth to Fourteenth Embodiments

The positional relationship between the center electrode tip 32 and the ground electrode tip 42 shown in the fifth embodiment can be modified as shown in FIGS. 21 to 26.

Figure 21:
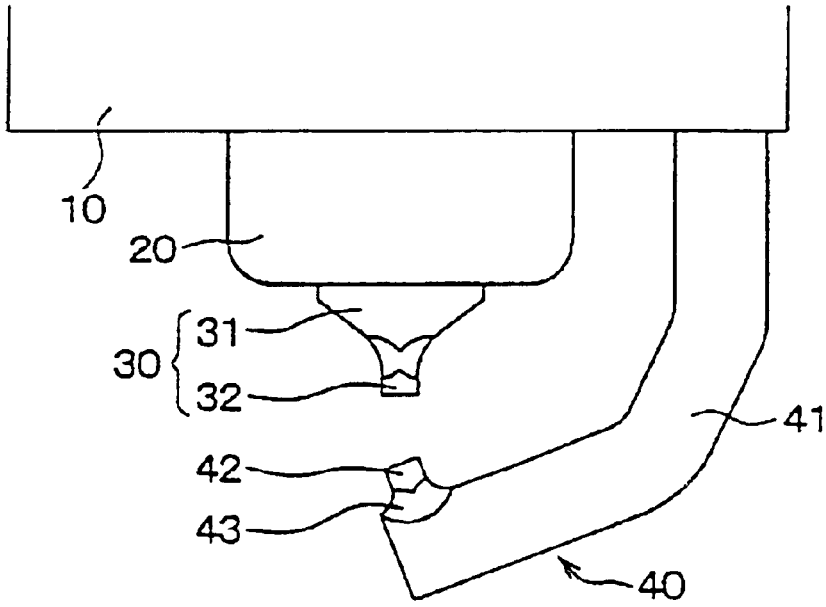
FIG. 21 is a diagram showing an essential arrangement of a spark plug in accordance with a ninth embodiment of the present invention.

According to a ninth embodiment of the present invention shown in FIG. 21, the axis of ground electrode tip 42 is inclined with respect to the axis of center electrode tip 32. The axis of center electrode tip 32 intersects with the ground electrode tip 42 so that the ground electrode tip 42 and the center electrode tip 32 are substantially opposed.

The ground electrode tip 42 is welded on an outer side surface of the rodlike support member 41.

Figure 22:
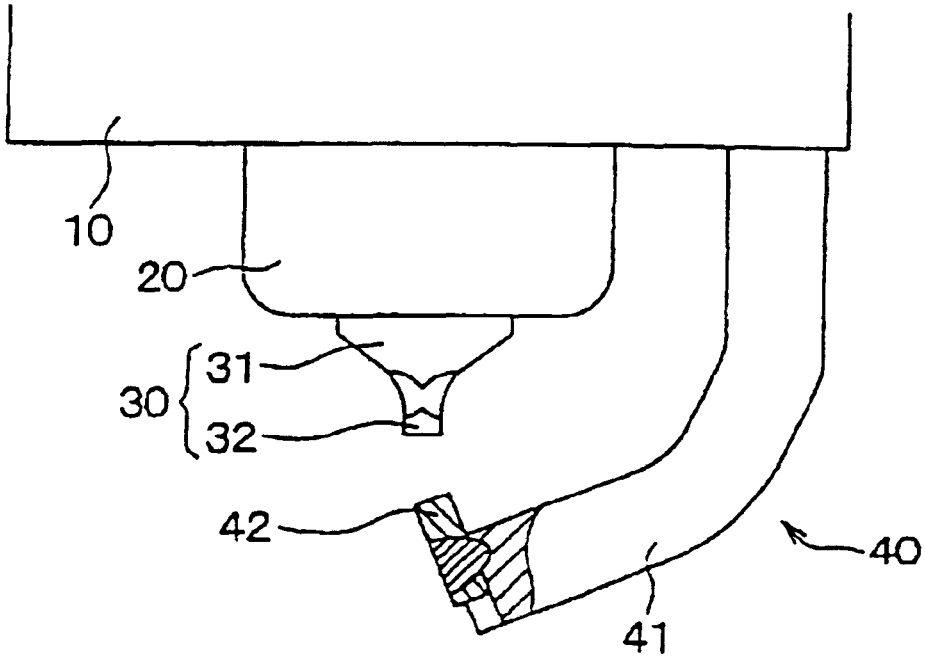
FIG. 22 is a diagram showing an essential arrangement of a spark plug in accordance with a tenth embodiment of the present invention.

According to a tenth embodiment of the present invention shown in FIG. 22, the ground electrode tip 42 is welded on the distal end surface of the rodlike support member 41.

Figure 23:
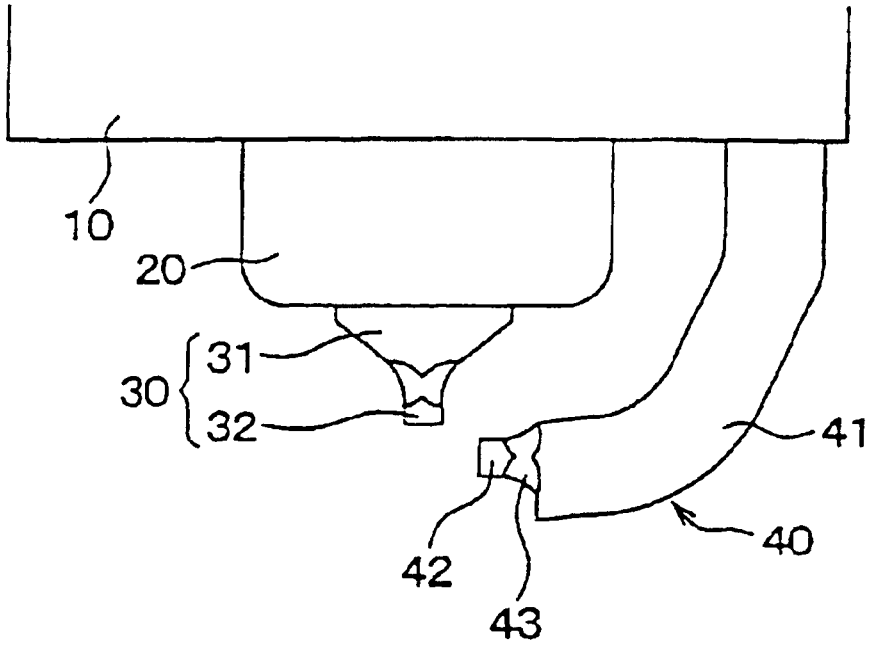
FIG. 23 is a diagram showing an essential arrangement of a spark plug in accordance with an eleventh embodiment of the present invention.

According to an eleventh embodiment of the present invention shown in FIG. 23, the axis of ground electrode tip 42 is perpendicular to the axis of center electrode tip 32. The axis of center electrode tip 32 does not intersect with the ground electrode tip 42.

Figure 24:
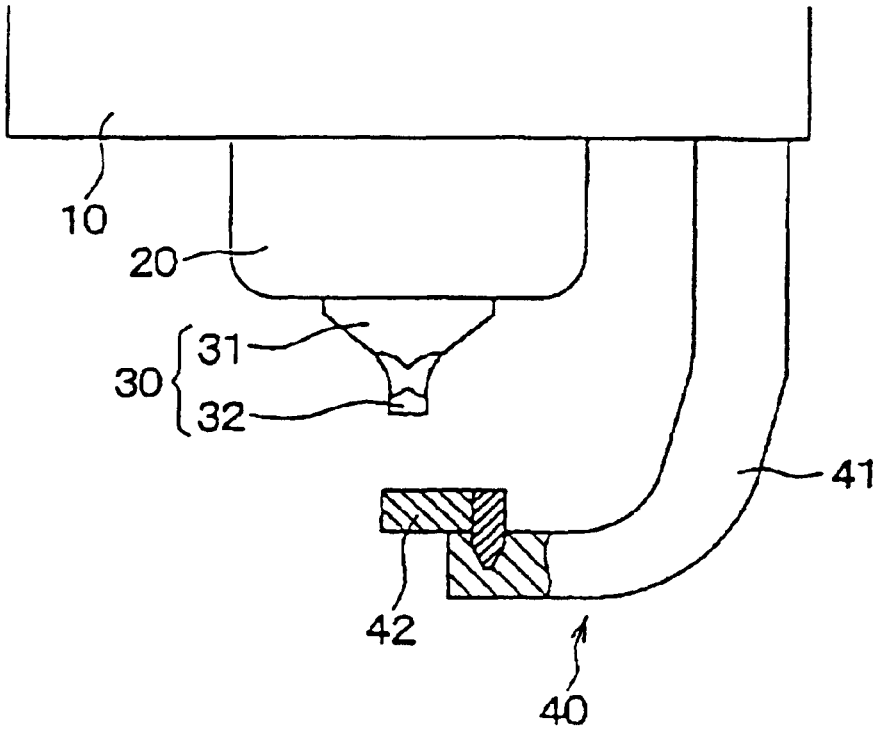
FIG. 24 is a diagram showing an essential arrangement of a spark plug in accordance with a twelfth embodiment of the present invention.

According to a twelfth embodiment of the present invention shown in FIG. 24, the axis of ground electrode tip 42 is perpendicular to the axis of center electrode tip 32. The axis of center electrode tip 32 intersects with an outer cylindrical surface of ground electrode tip 42. In other words, the ground electrode tip 42 opposes with the center electrode tip 32 at its outer cylindrical surface.

Figure 25:
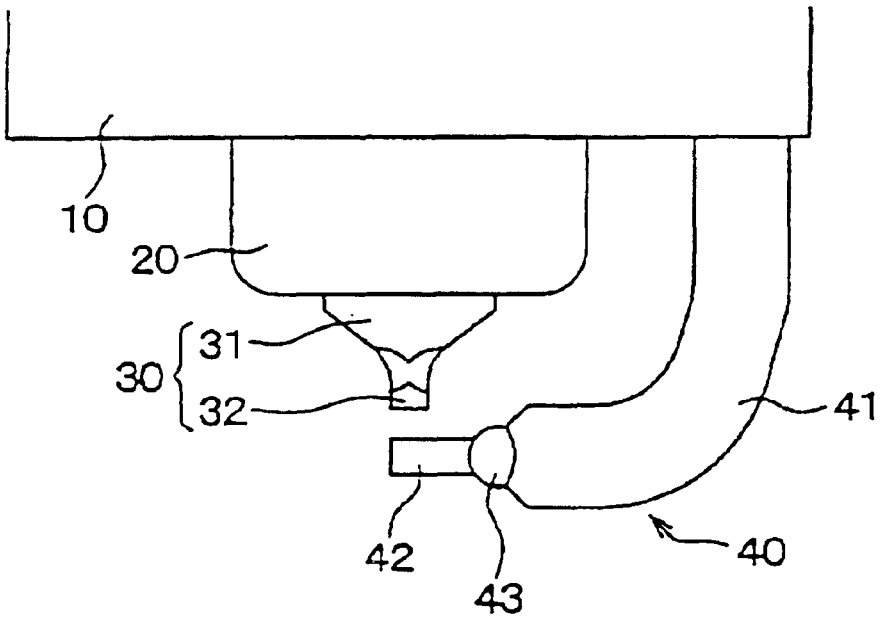
FIG. 25 is a diagram showing an essential arrangement of a spark plug in accordance with a thirteenth embodiment of the present invention.

According to a thirteenth embodiment of the present invention shown in FIG. 25, the ground electrode tip 42 is welded on the distal end surface of the rodlike support member 41.

Figure 26:
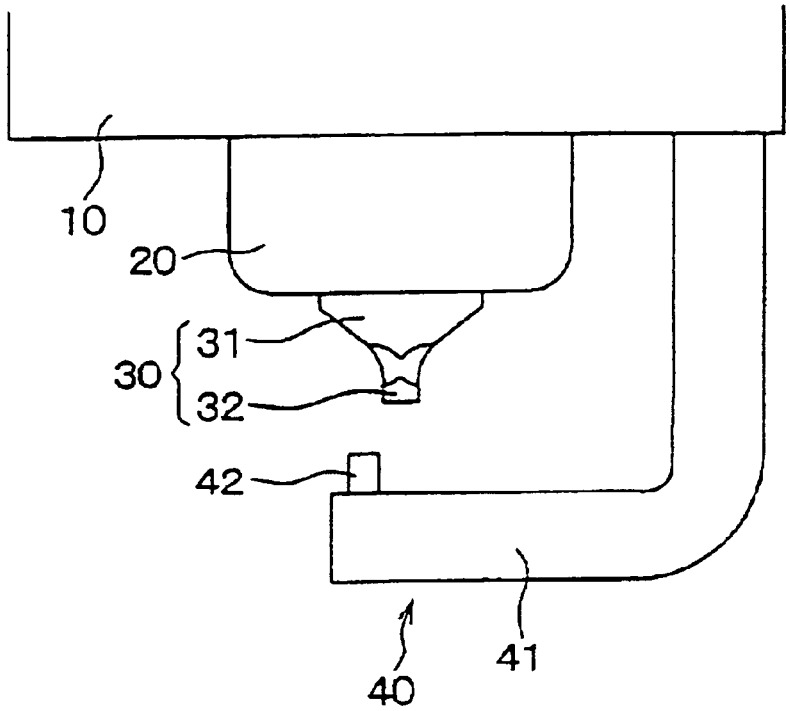
FIG. 26 is a diagram showing an essential arrangement of a spark plug in accordance with a fourteenth embodiment of the present invention.

According to a fourteenth embodiment of the present invention shown in FIG. 26, the axis of ground electrode tip 42 is parallel to and non-coaxial with the axis of center electrode tip 32.

According to the above-described ninth to fourteenth embodiments, the midpoint P of the discharge gap R1 resides on a straight and shortest line connecting the tips 32 and 42.

Fifteenth to twentieth Embodiments

The configuration of center electrode tip 32 and ground electrode tip 42 shown in the fifth embodiment can be modified as shown in FIGS. 27 to 32.

In general, when an electrode has a ridge whose curvature radius is equal to or less than 0.2 mm, the electric field strength can be maintained at a higher value locally. Hence, it is preferable to maintain the curvature radius equal to or less than 0.2 mm even after the ground electrode tip 42 is worn.

Figure 27:
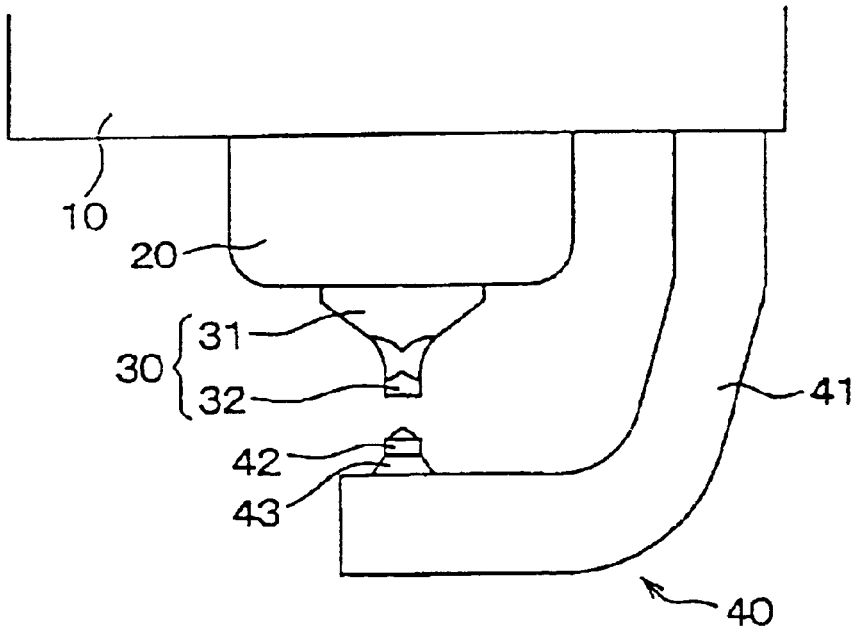
FIG. 27 is a diagram showing an essential arrangement of a spark plug in accordance with a fifteenth embodiment of the present invention.

According to a fifteenth embodiment of the present invention shown in FIG. 27, the ground electrode tip 42 consists of a cylindrical rod portion and a circular cone portion. A pinnacle of the circular cone portion is closest to the center electrode tip 32.

Figure 28:
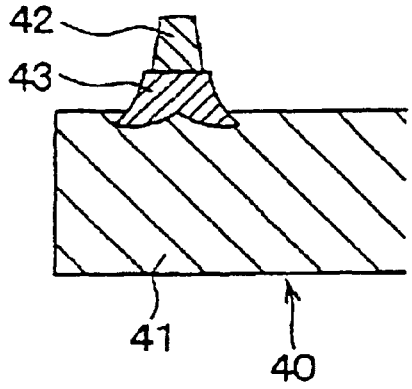
FIG. 28 is a diagram showing an essential arrangement of a spark plug in accordance with a sixteenth embodiment of the present invention.

According to a sixteenth embodiment of the present invention shown in FIG. 28, the ground electrode tip 42 is configured into a truncated conical shape.

Figure 29:
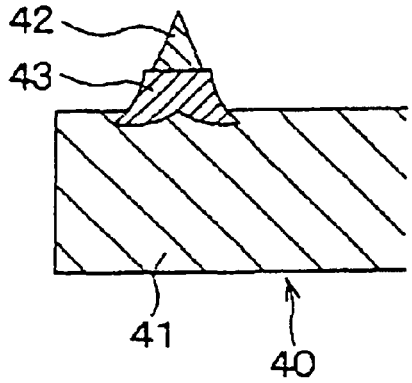
FIG. 29 is a diagram showing an essential arrangement of a spark plug in accordance with a seventeenth embodiment of the present invention.

According to a seventeenth embodiment of the present invention shown in FIG. 29, the ground electrode tip 42 is configured into a simple conical shape.

Figure 30:
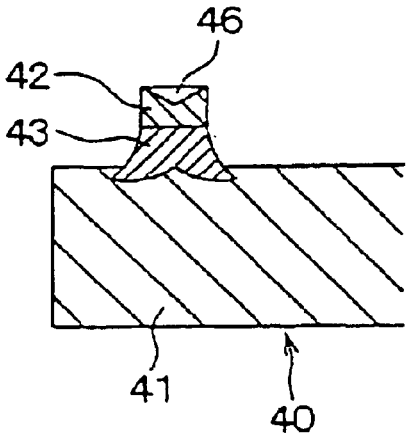
FIG. 30 is a diagram showing an essential arrangement of a spark plug in accordance with an eighteenth embodiment of the present invention.

According to an eighteenth embodiment of the present invention shown in FIG. 30, the ground electrode tip 42 is configured into a cylindrical rod with a conical recess 46 formed on the top thereof.

Figure 31:
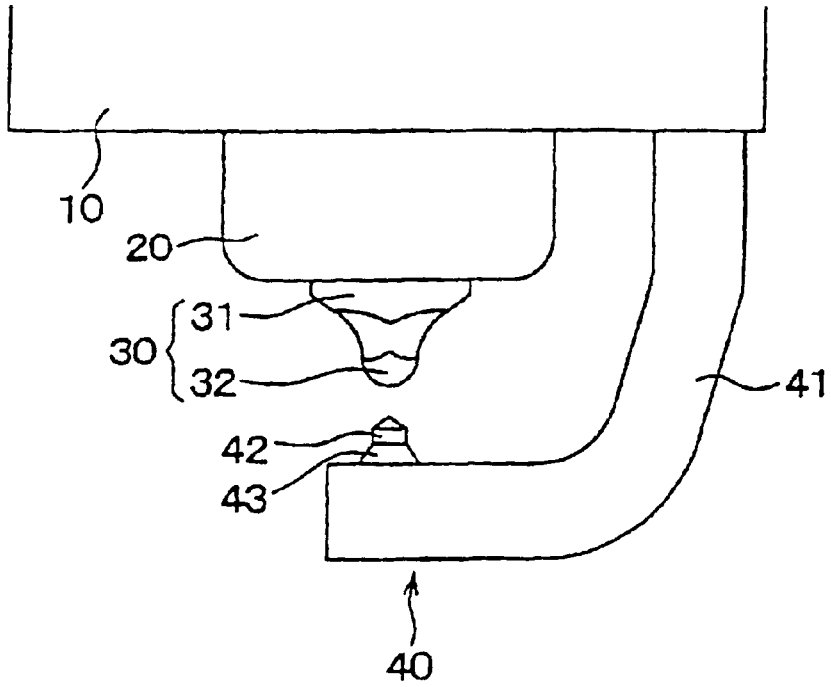
FIG. 31 is a diagram showing an essential arrangement of a spark plug in accordance with a nineteenth embodiment of the present invention.

According to a nineteenth embodiment of the present invention shown in FIG. 31, the center electrode tip 32 has a spherical heat whose curvature radius is sufficiently larger than 0.2 mm. In this case, it becomes possible to enlarge the electric field strength between the center electrode 30 and the ground electrode 40, thereby surely concentrating the discharge energy toward the ground electrode 40. Furthermore, as a ratio of surface to volume of the center electrode 30 is small, it becomes possible to prevent the center electrode 30 from absorbing the heat of a flame.

Figure 32:
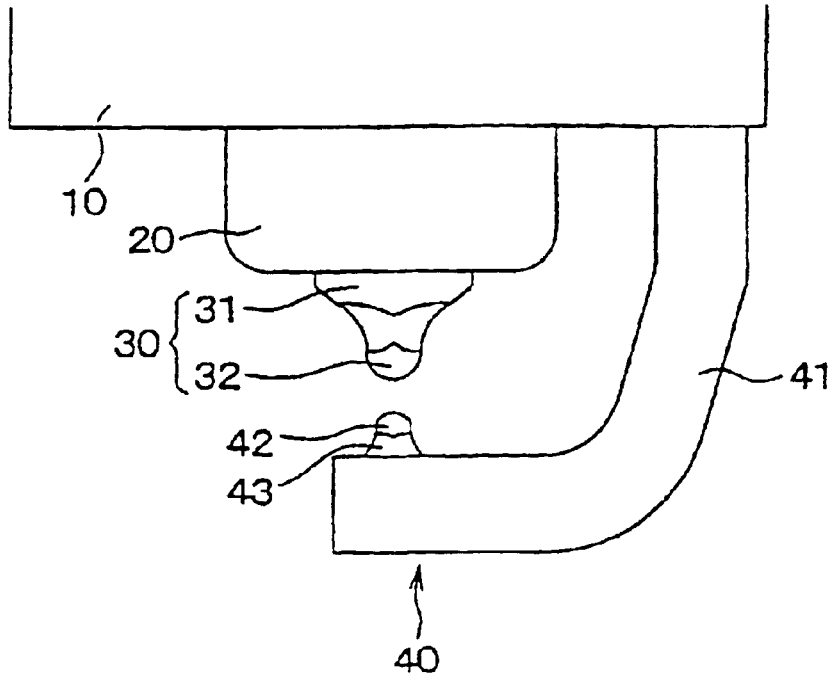
FIG. 32 is a diagram showing an essential arrangement of a spark plug in accordance with a twentieth embodiment of the present invention.

According to a twentieth embodiment of the present invention shown in FIG. 32, the ground electrode tip 42 has a spherical head whose curvature radius is equal to or smaller than 0.2 mm. In this case, it becomes possible to enlarge the electric field strength locally. Furthermore, as a ratio of surface to volume of the ground electrode 40 is small, it becomes possible to prevent the ground electrode 40 from absorbing the heat of a flame.

Other Modifications

According to the above-described fifth to twentieth embodiments, the ground electrode tip 42 has a small cross section so as to assure active release of thermoelectrons. However, considering the durability to heat and acid, it is preferable that the cross section of ground electrode tip 42 is equal to or larger than 0.13 $mm^2$ (equivalent to 0.4 mm in terms of diameter of a cylindrical rod) in a spherical region where the distance R2 from the midpoint P of the discharge gap R1 is within $\frac{1}{2}\times$R1+0.1 mm.

Furthermore, to satisfy both of the ignitability and the heat and acid resistivity, it is preferable to that the center electrode tip 32 and the ground electrode tip 42 have cross sections in a range from 0.13 $mm^2$ to 0.5 $mm^2$ (equivalent to 0.4 mm to 0.8 mm in terms of diameter of a cylindrical rod) when positioned in a spherical region where the distance R2 from the midpoint P is within $\frac{1}{2}\times$R1+0.1 mm.

Furthermore, to solve a problem of impurities depositing between the center electrode 32 and the ground electrode 42, a preferable value of the discharge distance R1 is equal to or larger than 0.3 mm.

Moreover, to realize the downsizing of a spark plug, a preferable value of the discharge distance R1 is equal to or smaller than 0.8 mm.

This invention may be embodied in several forms without departing from the spirit of essential characteristics thereof. The present embodiments as described are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A spark plug comprising a center electrode and a ground electrode spaced in an opposed relationship, wherein said center electrode comprises an iridium alloy, a discharge gap between said center electrode and said ground electrode is less than 1.1 mm, cross sections of said center electrode and said ground electrode are equal to or smaller than 0.95 $mm^2$ in a spherical region where a distance from a midpoint of said discharge gap is within 0.6 mm, and a distal end portion of said center electrode includes a tip and a base portion supporting said tip, wherein said tip is configured into a cylindrical rod shape extending straight, and said base portion is configured into a truncated conical shape having a tapered surface expanding from a top of said base portion to a bottom of said base portion.

2. A spark plug comprising a center electrode and a ground electrode spaced in an opposed relationship, wherein said center electrode comprises an iridium alloy, said ground electrode comprises an alloy other than said iridium alloy, a discharge gap between said center electrode and said ground electrode is less than 1.1 mm, cross sections of said center electrode and said ground electrode are equal to or smaller than 0.95 $mm^2$ in a spherical region where a distance from a midpoint of said discharge gap is within 0.6 mm, and a voltage applied to said center electrode is lower than a voltage applied to said ground electrode.

* * * * *